US011523953B2

(12) United States Patent
Morgan et al.

(10) Patent No.: US 11,523,953 B2
(45) Date of Patent: Dec. 13, 2022

(54) WHEELCHAIR EGRESS SYSTEM

(71) Applicant: Direct Supply, Inc., Milwaukee, WI (US)

(72) Inventors: Justin T. Morgan, Cedarburg, WI (US); Anthony J. Patrick, Delafield, WI (US); Joshua J. Jakubowski, Port Washington, WI (US); Jason Ronald Geidel, Kewaskum, WI (US); Michael Dennis Peters, West Bend, WI (US)

(73) Assignee: Direct Supply, Inc., Milwaukee, WI (US)

( * ) Notice: Subject to any disclaimer, the term of this patent is extended or adjusted under 35 U.S.C. 154(b) by 392 days.

(21) Appl. No.: 16/689,713

(22) Filed: Nov. 20, 2019

(65) Prior Publication Data

US 2020/0155391 A1 May 21, 2020

Related U.S. Application Data

(60) Provisional application No. 62/769,665, filed on Nov. 20, 2018.

(51) Int. Cl.
*A61G 5/14* (2006.01)
*A61G 5/10* (2006.01)

(52) U.S. Cl.
CPC ..... *A61G 5/14* (2013.01); *A61G 5/101* (2013.01); *A61G 5/1059* (2013.01)

(58) Field of Classification Search
CPC ..... A61G 5/14; A61G 5/101; A61G 5/1018; A61G 5/1013; A61G 5/1059
See application file for complete search history.

(56) References Cited

U.S. PATENT DOCUMENTS

| | | | |
|---|---|---|---|
| X974769 | | 11/1920 | Hoff |
| 3,023,048 | A | 2/1962 | Barton |
| 4,076,304 | A | 2/1978 | Deucher |
| 4,519,649 | A | 5/1985 | Tanaka et al. |
| 4,569,556 | A | 2/1986 | Pillot |
| 4,629,162 | A | 12/1986 | Porche |

(Continued)

OTHER PUBLICATIONS

"Carex Upeasy Seat Assist", https://www.walmart.com/ip/Carex-Upeasy-Seat-Assist-Lifting-Seat-Standard-Size/25490686?wmlspartner=wlpa&selectedSellerId=0&adid=22222222227018395959&wl0=&wl1=g&wl2=c&wl3=40754489192&wl4=pla-78607083752&wl5=9018848&wl6=&wl7=&wl8=&wl9=pla&wl10=8175035&wl11=online&wl12=25490686&wl13=&veh=sem.

(Continued)

*Primary Examiner* — Tony H Winner
*Assistant Examiner* — Harold Eric Pahlck, III
(74) *Attorney, Agent, or Firm* — Boyle Fredrickson, S.C.

(57) ABSTRACT

The present invention provides an assembly having a wheelchair and a lift assembly to urge the seat surface upward with respect to the frame from a lowered position when supporting the seated individual during use to an elevated position with respect to the frame assisting the individual during ingress or egress to or from the wheelchair. The lift assembly may include a mechanical linkage and an actuator. The assembly also provides at least one brake configured to block rotation of the wheelchair wheel with respect to the wheelchair frame in a locked state and disengaging with the wheels to allow rotation of the wheel with respect to the frame in an unlocked state. The assembly also provides a brake linkage communicating between the lift assembly and the brake to move the brake into the lock state when the seat surface moved to the elevated position.

29 Claims, 17 Drawing Sheets

(56) References Cited

U.S. PATENT DOCUMENTS

| | | | | |
|---|---|---|---|---|
| 4,838,612 | A | 6/1989 | Cross | |
| 4,929,022 | A | 5/1990 | Geraci | |
| 5,055,518 | A | 10/1991 | Dupont et al. | |
| 5,116,100 | A | 5/1992 | Iversen | |
| 5,224,750 | A | 7/1993 | Clark et al. | |
| 5,316,370 | A | 5/1994 | Newman | |
| 5,333,931 | A | 8/1994 | Weddendorf | |
| 5,513,867 | A | 5/1996 | Bloswick et al. | |
| 5,520,403 | A | 5/1996 | Bergstrom et al. | |
| 5,556,121 | A | 9/1996 | Pillot | |
| 5,918,936 | A | 7/1999 | Murphy | |
| 6,113,188 | A | 9/2000 | Stewart et al. | |
| 6,213,554 | B1 | 4/2001 | Marcoux et al. | |
| 6,425,634 | B1 | 7/2002 | Romero | |
| 6,454,285 | B1 | 9/2002 | Koenig | |
| 6,637,818 | B2 | 10/2003 | Williams | |
| 6,688,437 | B2 | 2/2004 | Usherovich | |
| 6,793,232 | B1 | 9/2004 | Wing | |
| 6,851,751 | B1 | 2/2005 | Romero et al. | |
| 7,055,840 | B1 | 6/2006 | Kelso | |
| 7,097,189 | B2 | 8/2006 | Hsu | |
| 7,165,778 | B2 | 1/2007 | Kuiken | |
| 7,594,698 | B1 | 9/2009 | Palmer | |
| 8,360,518 | B2 | 1/2013 | Braaten | |
| 8,590,920 | B2 * | 11/2013 | Masaki | A61G 5/0825 280/650 |
| 9,301,896 | B2 | 4/2016 | Hsieh | |
| 9,693,914 | B2 * | 7/2017 | Ooyama | A61G 5/02 |
| 2005/0000755 | A1 * | 1/2005 | Ikegami | B60T 11/046 188/26 |
| 2008/0133089 | A1 * | 6/2008 | Bayomy | A61G 5/1054 701/49 |
| 2012/0241265 | A1 * | 9/2012 | Ooyama | A61G 5/1054 188/2 F |
| 2020/0150607 | A1 | 5/2020 | Matlin | |

OTHER PUBLICATIONS

"Carex Premium Lifting Seat Assist With Memory Foam", o https://www.walmart.com/ip/Uplift-Premium-Portable-Power-Seat-20/21453290?wmlspartner=wlpa&selectedSellerId=0&adid=22222222227015460894&wl0=&wl1=g&wl2=c&wl3=40753569512&wl4=pla-78604384832&wl5=9018848&wl6=&wl7=&wl8=&wl9=pla&wl10=8175035&wl11=online&wl12=21453290&wl13=&veh=sem#about-item.

"Karman Lightweight Flower Standing Wheelchair Seat", o https://www.walmart.com/ip/Karman-Lightweight-Power-Standing-Wheelchair-Seat-Artic-Silver-18-Inch/265947119?wmlspartner=wlpa&selectSellerId=9044&adid=22222222227094431574&wmlspartner=wmtlabs&wl0=&wl1=g&wl2=c&wl3=215316105990&wl4=pla-347261953369&wl5=9018848&wl6=&wl7=&wl8=&wl9=pla&wl10=115785754&wl11=online&wl12=265947119&wl13=&veh=sem.

"Mobile Commode Chair With Assistant Seat", o https://www.walmart.com/ip/Mobile-Commode-Chair-with-Assistive-Seat-Helps-User-to-Sit-Down-Get-Up/766412863?wmlspartner=wlpa&selectedSellerId=0&adid=22222222227093357178&wmlspartner=wmtlabs&wl0=&wl1=g&wl2=c&wl3=212773995525&wl4=pla-344342590925&wl5=9018848&wl6=&wl7=&wl8=&wl9=pla&wl10=8175035&wl11=online&wl12=766412863&wl13=&veh=sem.

* cited by examiner

WHEELCHAIR EGRESS SYSTEM

CROSS REFERENCE TO RELATED APPLICATION

This application claims priority to U.S. Provisional Patent Application Ser. No. 62/769,665 filed on Nov. 20, 2018, the entirety of which is incorporated herein by reference.

BACKGROUND OF THE INVENTION

The present invention relates to a lift mechanism for use with a conventional wheelchair; and more specifically, relates to a mechanical seat lift mechanism to aid in the ingress and egress of a physically impaired individual from a wheelchair.

Conventional wheelchairs are commonly used to accommodate a variety of individual users, as well as intended to accommodate the different medical needs of those individuals. Some individuals that require the use of a wheelchair may experience difficulty sitting, i.e., ingressing, the wheelchair and/or rising from, egressing, the wheelchair. Such difficulties may arise from generally decreased physical strength or a temporary injury or ailment. Regardless of the cause of the user's difficulty in ingressing/egressing the wheelchair, there remains the need to independently and securely assist in the transfer of an individual to and from the seated position, without the assistance of another person.

Prior attempts to assist in raising and lowering an individual into the seat of a wheelchair include the use of electronically driven motors to actuate lift mechanisms in the seat. Still other systems utilize hydraulic systems, including fluid pumps, to actuate lift mechanisms in the seat. These prior solutions are undesirable as their substantial weight translates to increase force required to move the wheelchair and they cannot operate in the absence of a power supply, such as an on-board battery. Furthermore, such systems often require custom wheelchairs and are not well suited for retrofitting onto preexisting wheelchairs. Additionally, the relatively high cost of such complicated solutions may be cost prohibitive for many potential users. Accordingly, there is need for a relatively light weight mechanical seat lift mechanism to aid in the ingress and egress of a physically impaired individual from a wheelchair including a brake and brake linkage interfacing with the seat lift, which may be installed as original equipment on wheelchairs or retrofitted onto preexisting wheelchairs. There is also a need for a mechanical seat lift mechanism that automatically brakes the movement of the chair during user ingress and egress.

SUMMARY OF THE INVENTION

In one embodiment, the present invention provides an assembly having a wheelchair and a wheelchair lift. The wheelchair includes a frame having a seat surface configured for supporting a seated individual, a first and second wheel attached to the frame at the left and right sides of the seat surface that support the frame and can be rotated by the seated individual. The lift assembly is positioned between the seat surface and the frame to urge the seat surface upward with respect to the frame from a lowered position when supporting the seated individual during use to an elevated position with respect to the frame assisting the individual during ingress or egress to or from the wheelchair. The lift assembly comprises a first portion mounted to the frame, a second portion mounted to the seating surface and a mechanical lift linkage extending from the first portion to the second portion. An actuator extending from the first portion to the second portion facilitates raising the second portion. The assembly also includes a brake having a lock state that engages with the first and second wheel to block rotation of the first and second wheel with respect to the frame and an unlock state disengaging with the first and second wheel to allow rotation of the first and second wheel with respect to the frame. A brake linkage communicates between the lift assembly and the brake to move the brake from the unlock state to the lock state when the seat surface moves from the lowered position to the elevated position.

The wheelchair of the assembly may move in one direction when the brake is in the lock state to limit wheelchair rollback.

It is thus a feature of at least one embodiment of the invention to provide a brake in the lock state that blocks rotation of the first and second wheel with respect to the frame only against movement backwards of the wheelchair.

The wheelchair of the assembly may brake in both directions when the brake is in the lock state to immobilize the wheelchair.

It is thus a feature of at least one embodiment of the invention to provide a brake in the lock state that blocks rotation of the first and second wheel with respect to the frame in the forward and backward directions.

The wheelchair of the assembly may be moved when an individual is not seated in the seat surface.

It is thus a feature of at least one embodiment of the invention to provide the mechanical lift linkage with a releasable stop to override of the brake and allow the first and second wheels to rotate independent of a position of the seat surface.

The wheelchair of the assembly may be a collapsible wheelchair.

It is thus a feature of at least one embodiment of the invention to provide the frame with hinging members to allow the frame to fold to bring the first and second wheels together with the separation distance less than a width of the seat surface.

The wheelchair of the assembly may be manually braked independent of the state of the brake and brake linkage.

It is thus a feature of at least one embodiment of the invention to provide a manually activated secondary brake to block rotation of the first and second wheel with respect to the frame independent of the brake being in the lock state or unlock state.

The wheelchair of the assembly may accommodate wheelchairs of varying depth.

It is thus a feature of at least one embodiment of the invention to provide a seat pan with a first member affixed to the second portion of the lift assembly and a second member, adjustably engaging the first member, wherein the depth of the seat pan is variable by selectively adjusting a distance of overlap between the first and second members.

The wheelchair of the assembly may provide a lightweight mechanical actuator to drive the lift assembly.

It is thus a feature of at least one embodiment of the invention to provide at least one gas spring having a first end engaging the second portion of the lift assembly.

The wheelchair of the assembly may provide independent lift assembled associated with opposed side to the wheelchair to maintain collapsibility of the wheelchair.

It is thus a feature of at least one embodiment of the invention to provide a first and second lift subassembly that each include a first portion mounted to the wheelchair frame; a second portion mounted to a side edge of the seating surface; a mechanical lift linkage extending from the first portion to the second portion, and a lift actuator.

The lift assembly may be provided as a retrofit to an existing wheelchair.

It is thus a feature of at least one embodiment of the invention to provide a lift kit configured to be affixed to a collapsible wheelchair.

These and other features and aspects of the present invention will be better appreciated and understood when considered in conjunction with the following description and the accompanying drawings. It should be understood, however, that the following description, while indicating representative embodiments of the present invention, is given by way of illustration and not of limitation. Many changes and modifications may be made within the scope of the present invention without departing from the spirit thereof, and the invention includes all such modifications.

BRIEF DESCRIPTION OF THE DRAWINGS

A clear conception of the advantages and features constituting the present invention, and of the construction and operation of the present invention, will become more readily apparent by referring to the exemplary, and therefore non-limiting, embodiments illustrated in the drawings accompanying and forming a part of this specification, wherein like reference numerals designate the same elements in the several views, and in which.

DETAILED DESCRIPTION OF THE PREFERRED EMBODIMENT

Figure 1:
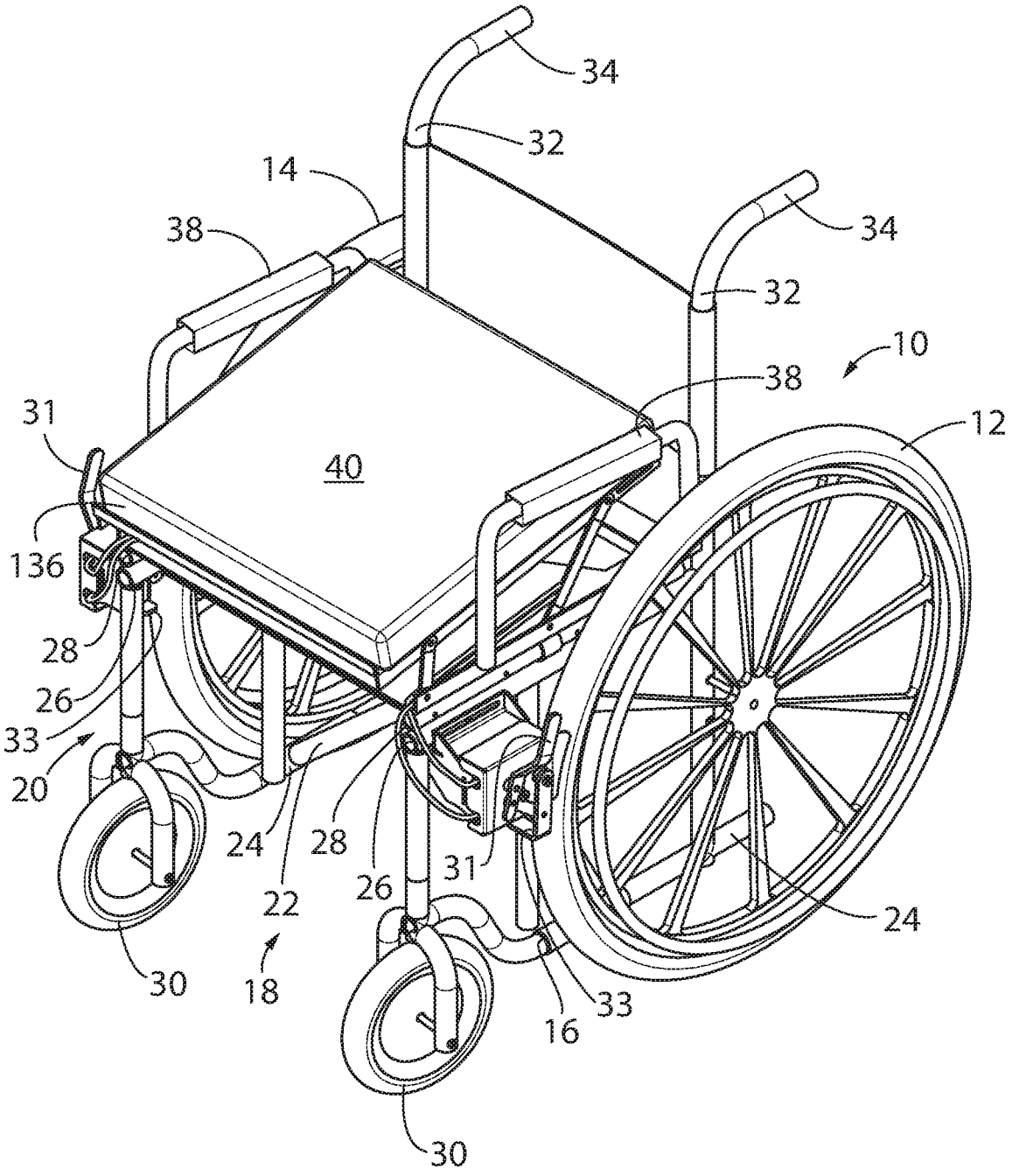
FIG. 1 is front side perspective view of a collapsible wheelchair in accordance with one embodiment of the present invention, with a seating surface and lift assembly in an elevated position and a brake mechanism engaging the wheels of the wheelchair.

Referring initially to FIG. 1, the general features of collapsible wheelchair 10 are shown in accordance with one embodiment of the present invention, including a first wheel 12 and a second wheel 14 located on opposing sides of a frame 16. The frame 16 includes first side frame subassembly 18 adjacent the first wheel 12 and a second side frame subassembly 20 adjacent the second wheel 14. A cross frame 22 configured in the shape of an "X" extends between the first side frame subassembly 18 and the second side frame subassembly 20, wherein the cross frame 22 may include hinging members or pivots to collapse the wheelchair 10 such that the wheels 12, 14 are separated by a distance less than a width of the seating surface of the wheelchair 10. Each of the first and second frame subassemblies 18, 20 further includes an anti-tilt or first horizontal tube 24, affixed to a portion of the cross frame 22 at or near the bottom of the wheelchair frame 16, and a second horizontal tube 26, affixed to a second portion of the cross frame 22, above the first horizontal tube 24. In some embodiments, as shown in FIG. 1, each subassembly 18, 20 of the wheelchair frame 16 may also include a third horizontal tube 28, positioned adjacent to or slightly above the second horizontal tube 26, which may function as a seat retention device. The wheels 12, 14, are generally affixed to the relative subassembly 18, 20, at or near the rear end of the first horizontal tube 24, while a castor wheel 30 may extend from an opposing front end of the first horizontal tube 24. A standard lever actuated wheel lock 31 may be mounted at or near the second horizontal tube 26, where downward motion on the handle forces a locking bar 33 into frictional engagement with the outer surface of the corresponding wheel 12, 14. A vertical tube 32 generally extends perpendicular to the first, second and third horizontal tubes 24, 26, 28, from the rear end of the first horizontal tube 24 to a distance above the third horizontal tube 28. The vertical tube 32 may terminate in a push handle 34 and define an attachment location 36 along its length for the seat beck 37, generally at a height above the third horizontal tube 28. As shown in FIG. 1, an armrest 38 may extend above the third horizontal tube 28, generally at a height between the seat surface 40 and the push handles 34.

In accordance with the wheelchair 10 shown in FIG. 1, the armrests 38 are often grasped by the user when ingressing and/or egressing the wheelchair 10. However, as was described above, some users may require additional assistance when transitioning from sitting or rising from the wheelchair 10. Accordingly, various embodiments of the present invention are described in further detail below with reference to the general features of a collapsible wheelchair 10, as was described above.

Figure 2:
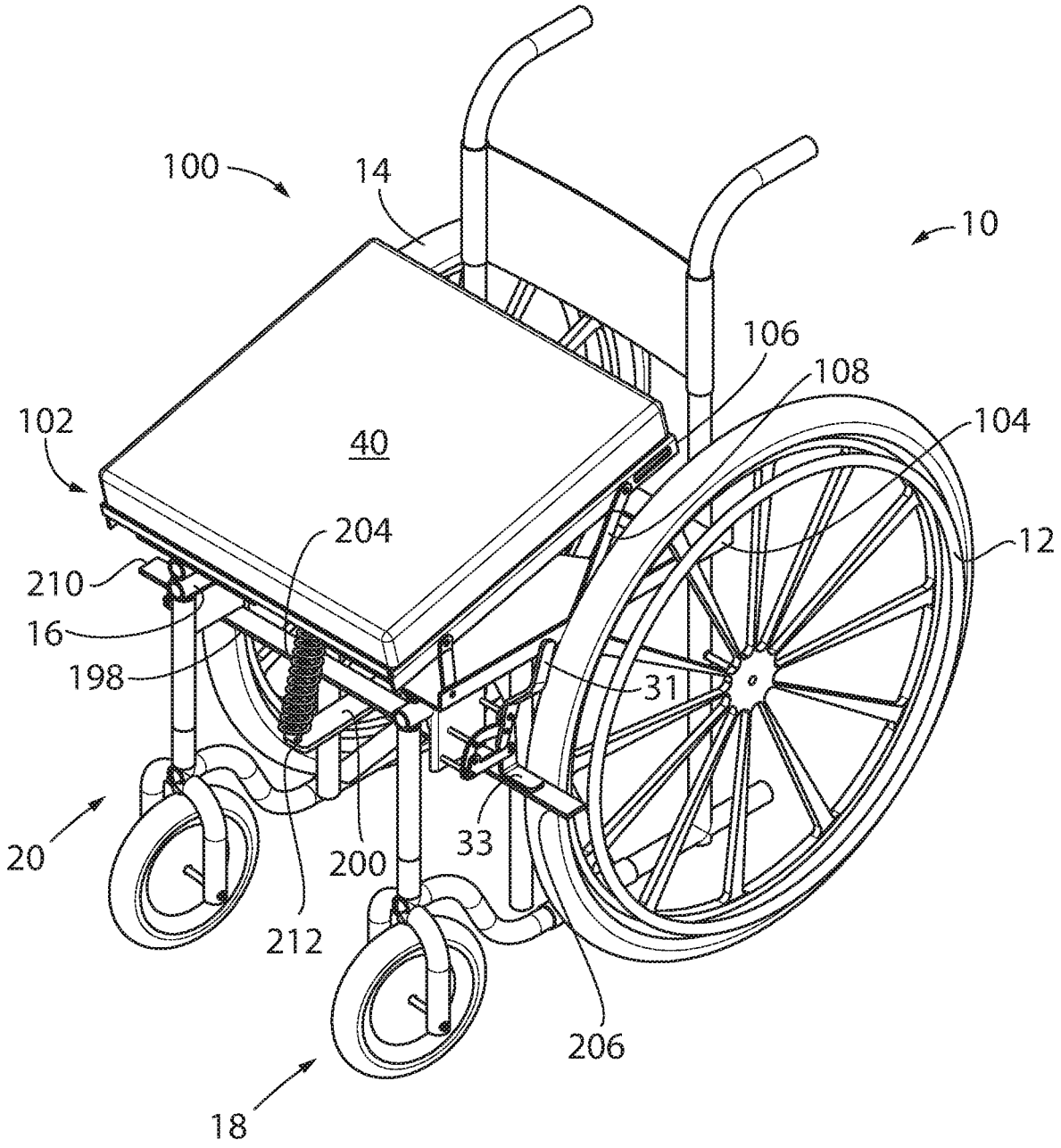
FIG. 2 is a front side perspective view of a collapsible wheelchair in accordance with one alternative embodiment of the present invention shown in FIG. 1 with a seating surface and lift assembly in an elevated position and a brake mechanism engaging the wheels of the wheelchair.
Figure 3:
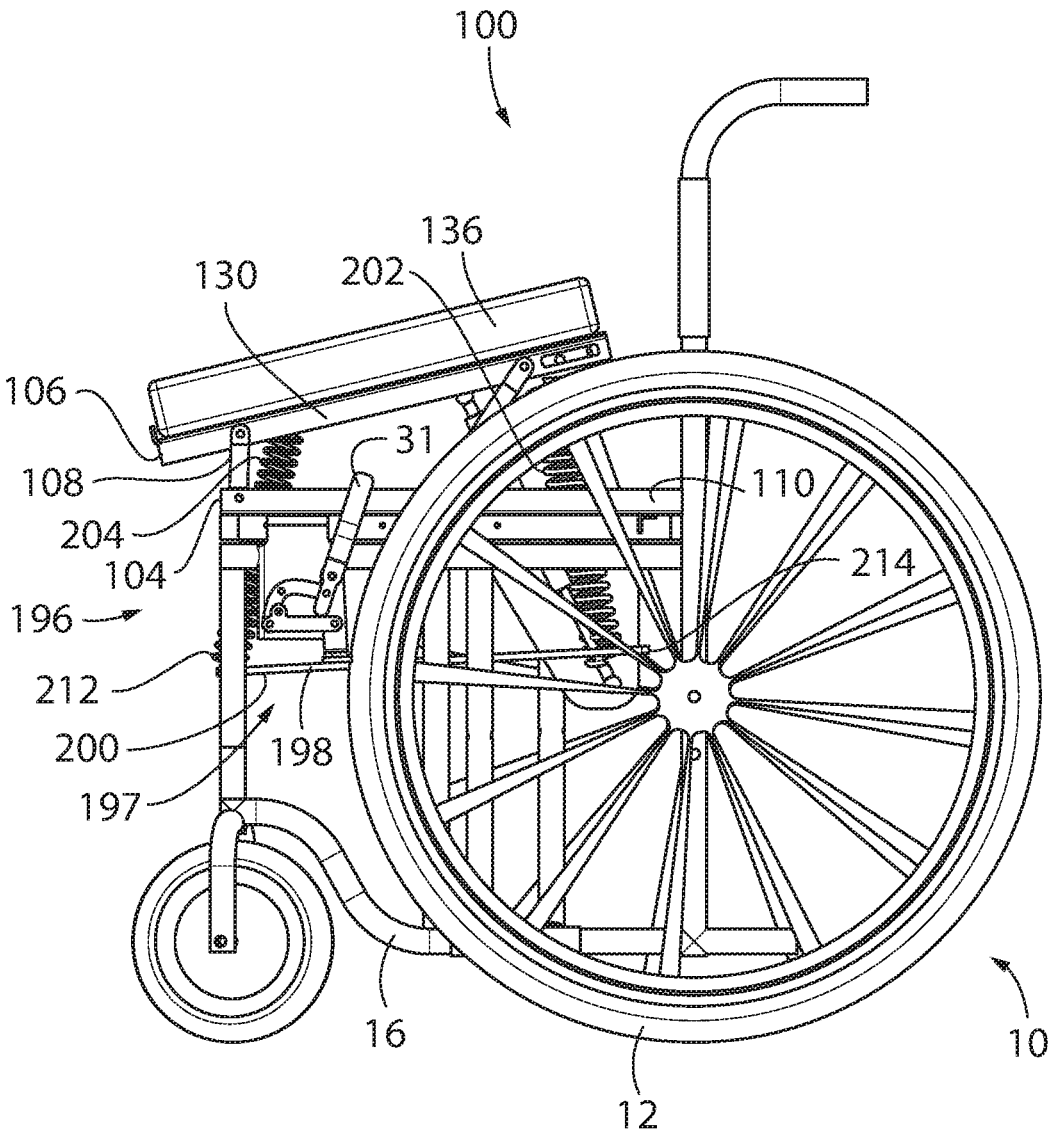
FIG. 3 is a side view of the collapsible wheelchair of FIG. 2.
Figure 4:
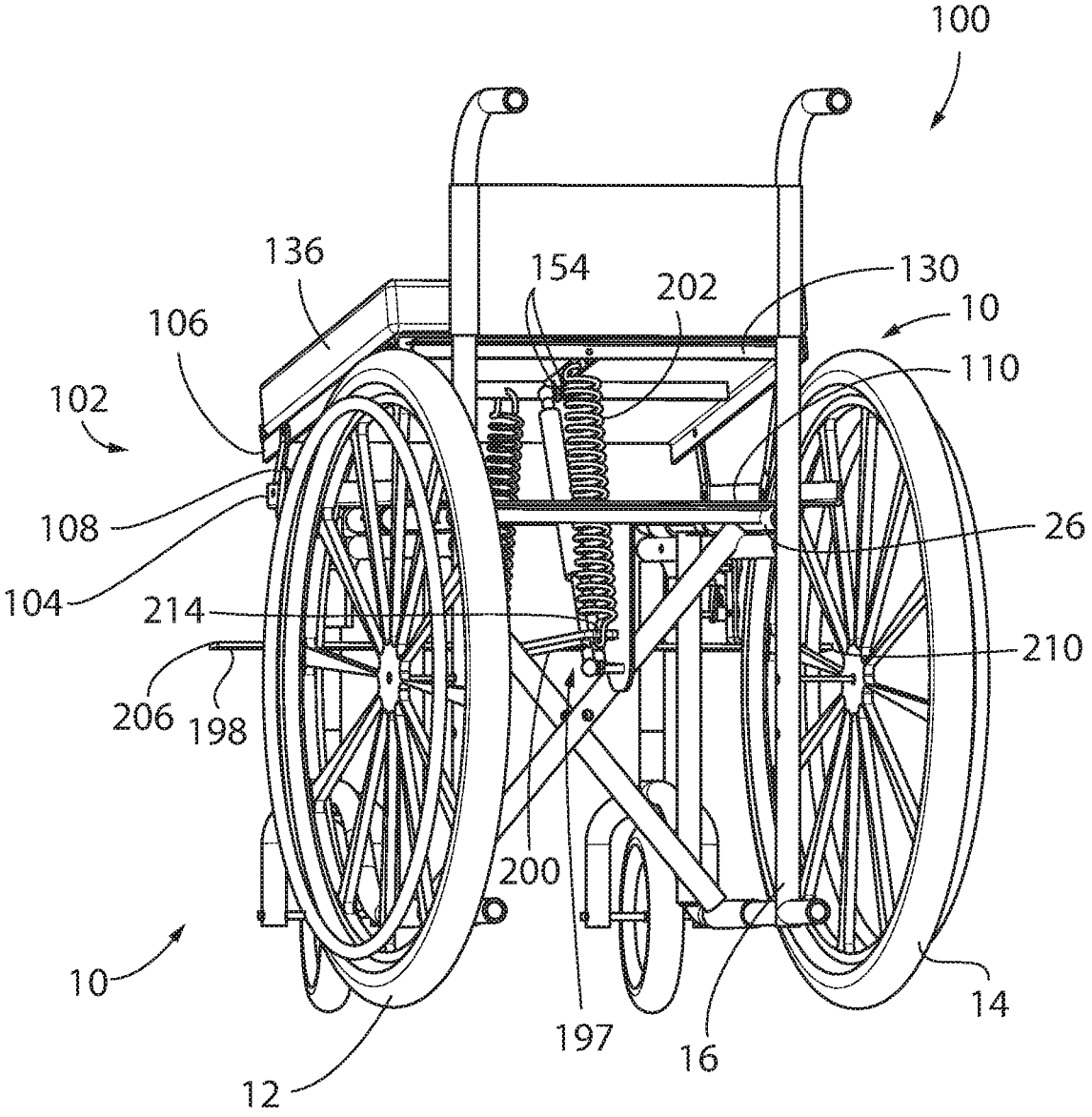
FIG. 4 is a rear bottom perspective view of the collapsible wheelchair of FIG. 2.

Turning now to FIGS. 2-7, and initially FIG. 2, in one embodiment, the present invention provides a wheelchair 10 that includes a lift assist device 100. Device 100 includes a lift assembly 102 that is generally positioned between the frame 16 of the wheelchair 10 and the seat surface 40. More specifically, the lift assembly 102 is positioned between the upper most horizontal bar, either the second horizontal bar 24 or third horizontal bar 26, of the wheelchair 10 and the seating surface 40. The lift assembly 102 includes a first portion 104 that is configured to be affixed to the third horizontal bar 26 of the frame 16 of the wheelchair 10, a second portion 106 that is mounted to or may alternatively form the seat surface 40 of the wheelchair 10 and a mechanical lift linkage 108 extending from the first portion 104 to the second portion 106.

Figure 5:
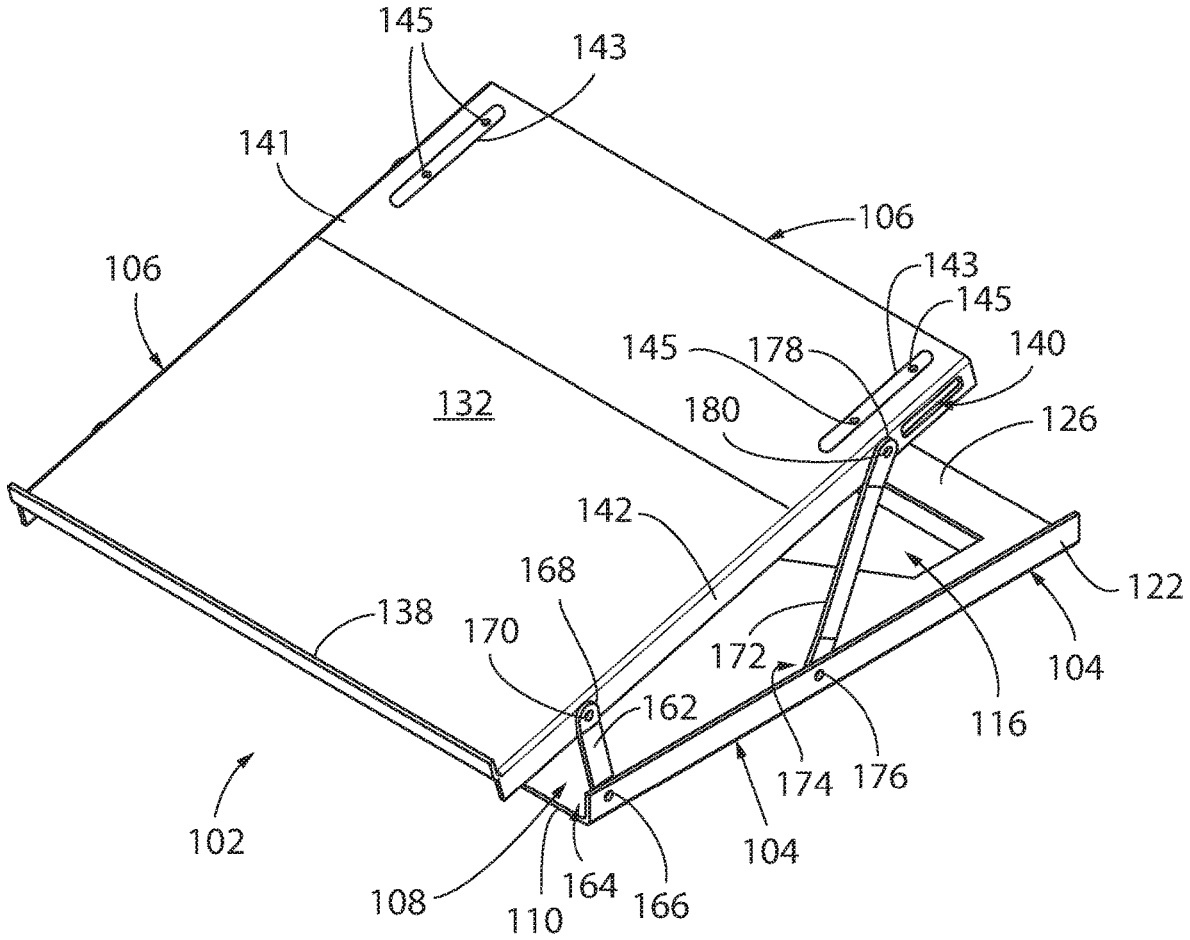
FIG. 5 is top front perspective view of one embodiment of the lift assembly of FIG. 2 in an elevated position.
Figure 6:
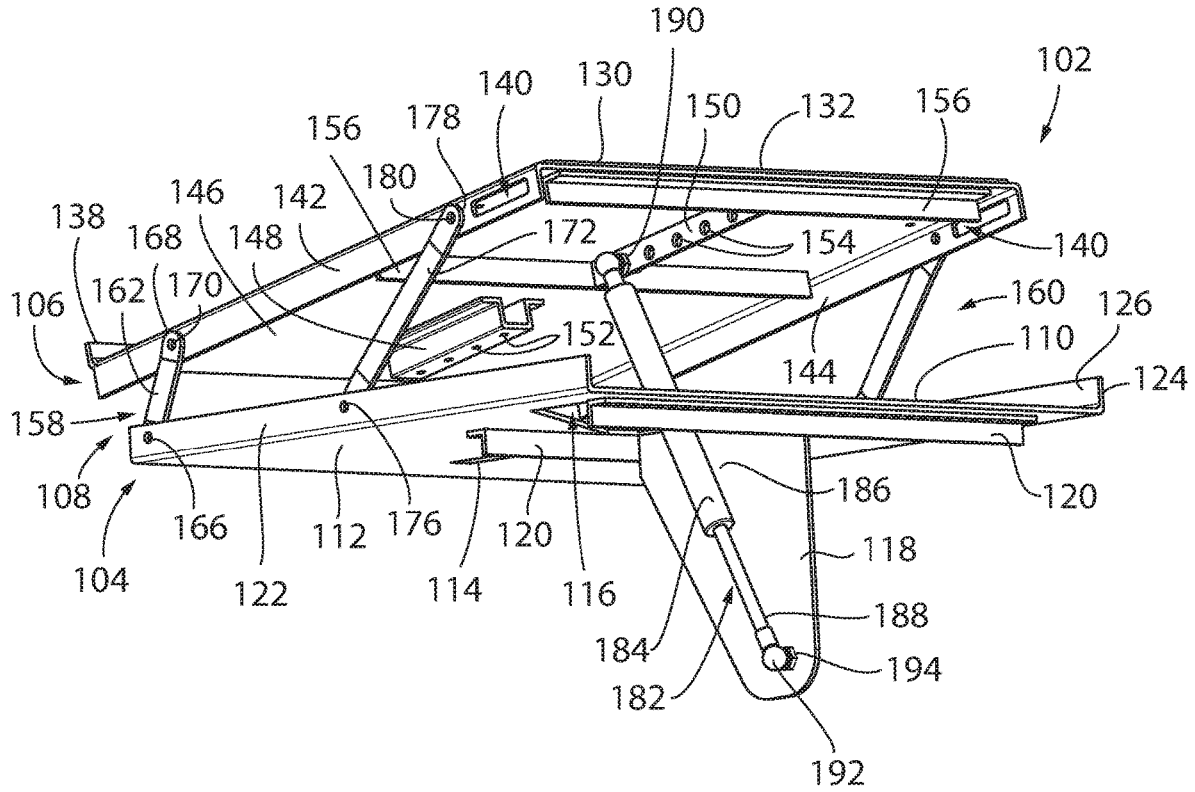
FIG. 6 is rear bottom perspective view of the lift assembly of FIG. 5.
Figure 7:
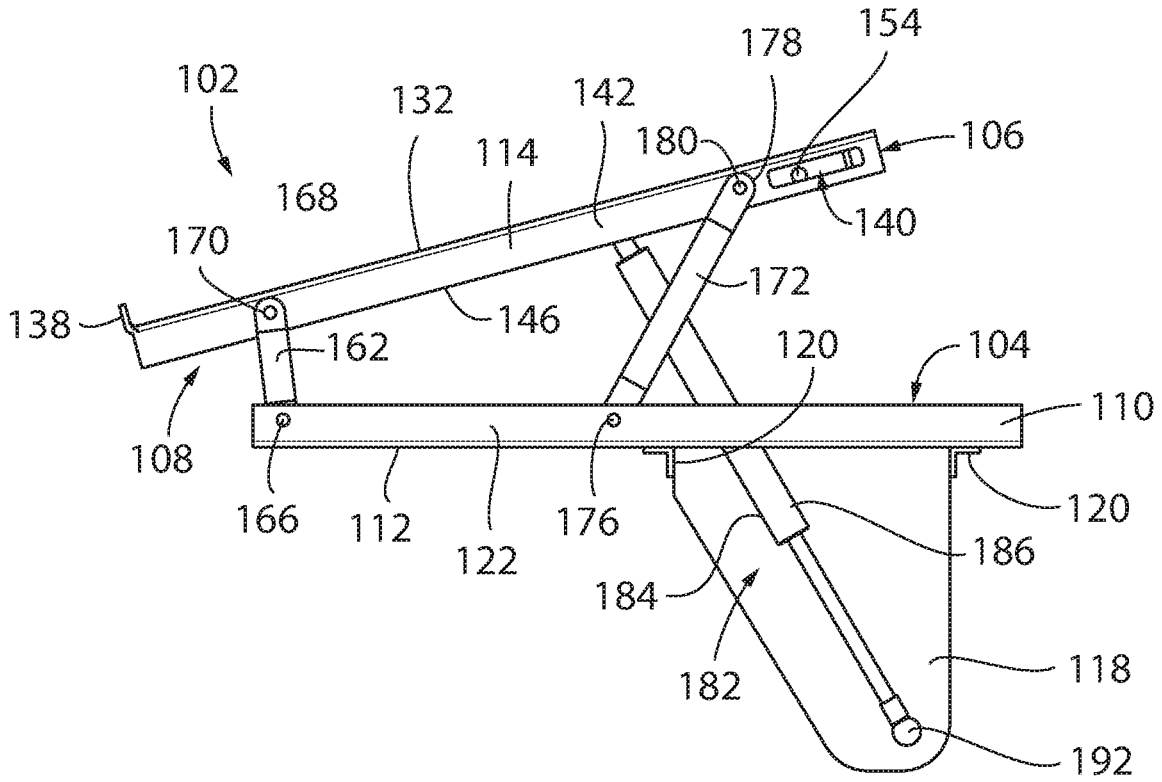
FIG. 7 is side view of the lift assembly of FIG. 5.
Figure 8:
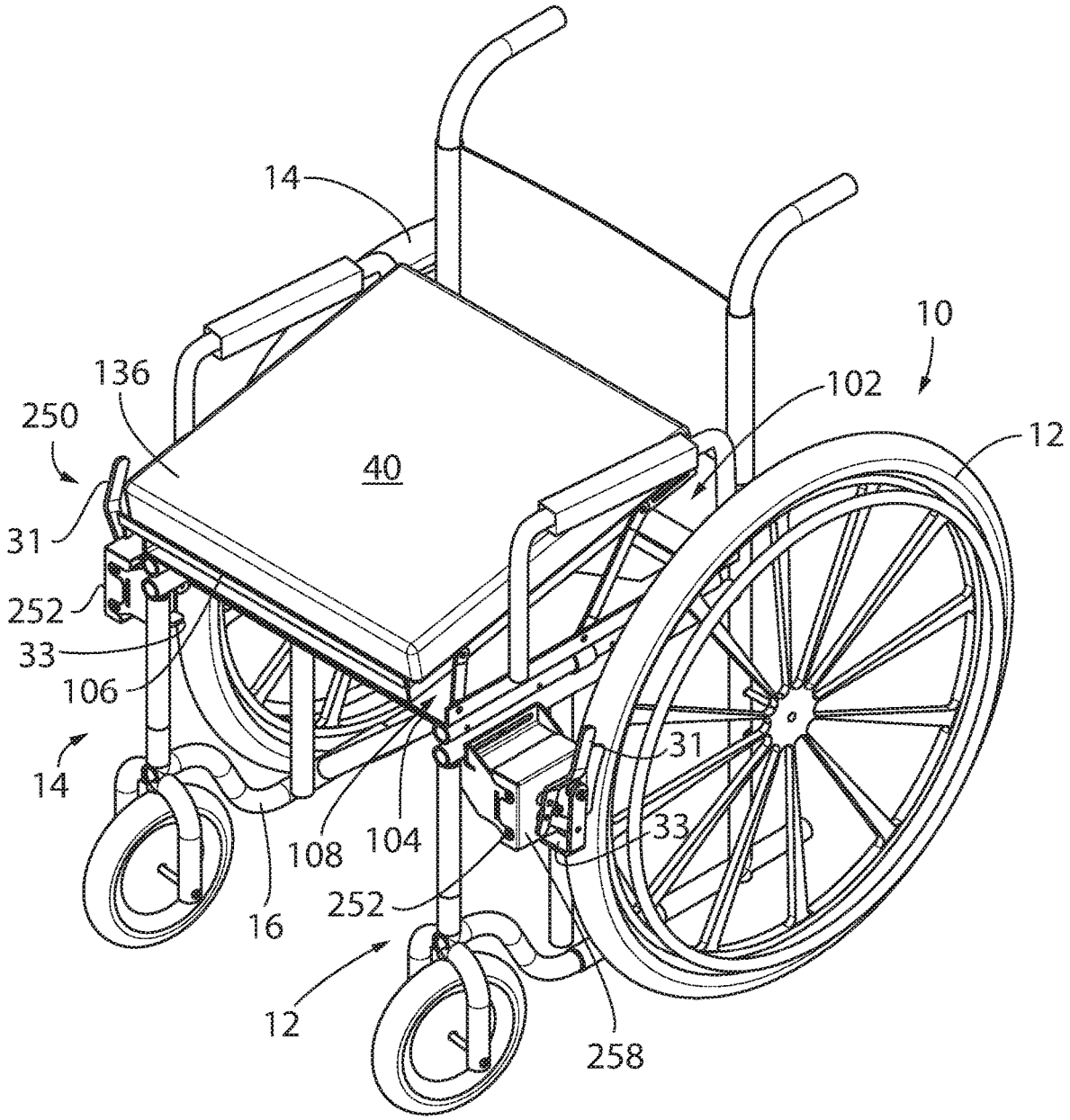
FIG. 8 is a front side perspective view of a collapsible wheelchair in accordance with one alternative embodiment of the present invention shown in FIG. 1 with a seating surface and lift assembly in an elevated position and a brake mechanism engaging the wheels of the wheelchair.

Still referring to FIGS. 2-7, and particularly FIGS. 5-7, the first portion 104 may be formed of a plate 110 that extends transversely between first side frame subassembly 18 and the second side frame subassembly 20 of the wheelchair 10 in a generally horizontal direction, such that it has a width approximately equal to that of the seat surface 40. The bottom surface 112 of the plate 110 may be affixed to the third horizontal bar 26 of the wheelchair 10 with fasteners, such as threaded fasteners that extent through the plate 110 and into the third horizontal bar 26 in order to mount the lift assembly 102 to wheelchair frame 16. However, it should be understood that additional fasteners, such as clamps, straps, welding and adhesive are considered well within the scope of the present invention.

The plate 110, which is preferably formed of metal but may be made of a rigid plastic, may include a first aperture 114 and a second aperture 116 that are positioned within the perimeter of the plate 110, with the first aperture 114 positioned forward of the second aperture 116. As will be described in further detail below, the first aperture 114 may provide an access through which a portion of the brake extends, while the second aperture 116 may provide an access through which a portion of the brake and/or a lift actuator may extend. Furthermore, a mounting support 118 may extend downwardly from the bottom surface 112 of the plate 110 adjacent the second aperture 116 as to provide a mounting location for the lift actuator, as will be described below. One or more cross bars 120 may extend transversely across the bottom surface 112 of the width of the plate 110 as to provide additional rigidity to the plate 110. The opposing lateral sides of the plate 110 may include a first raised edge 122 and an opposing second raised edge 124, which extend upwardly from the top surface 126 of the plate 110. The first and second raised edges 122, 124 provide a mounting location for the mechanical lift linkage 108 that extends from the first portion 104 to the second portion 106 and will be described in further detail below.

As shown in FIGS. 5-7, the second portion 106 of the lift assembly 102 may be formed of a seating pan 130 that is configured to rise into an elevated position with respect to the plate 110 and frame 16 of the wheelchair 10, as to assist an individual during ingress or egress to or from the wheelchair 10. The seating pan 130 is configured to extend between first side frame subassembly 18 and the second side frame subassembly 20 of the wheelchair 10 in a generally horizontal direction when receiving a seated individual thereon, such that it has a width approximately equal to that of the seat surface 40. In one embodiment of the present invention, the top surface 132 of the seating pan 130 may define the seating surface 40 and/or may be configured to receive a seating cushion 136 thereon. The seating cushion 136 may be retained on the top surface 132 of the seating pan 130 by a raised edge 138 disposed about the front edge of the seating pan 130. Alternatively, the seating pan 130 may include one or more mounting apertures 140 disposed therein through which the seating cushion 136 is attached. For example, the opposing lateral sides of the seating pan 130 may include a first lowered edge 142 and an opposing second lowered edge 144, which extend downwardly from the bottom surface 146 of the seating pan 130. A mounting aperture 140 may be disposed in each of the first and second lowered edges 142, 144, such that a webbing strap or similar mounting structure extending from the seating cushion 136 may be threaded through or otherwise affixed to the apertures 140. As shown in FIG. 5, the seating pan 130 may comprise a second portion 141, such as a plate that rests on top of the top surface 132. Channels 143 disposed within the second portion 141 overlie fastener mounting locations 145 in the underlying top surface 132 of the seating pan 130. The second portion 141 may slide along the top surface 132 and be fastened in a variable position by one or more fasteners extending through the channels 143 and engaging the mounting locations 145. In this arraignment the depth of the seating pan 130 may be varied to accommodate wheelchairs 10 having various depth seating surfaces 40.

Still referring to the seating pan 130, the first and second lowered edges 142, 144, located at the lateral sides of the seating pan 130, additionally provide a mounting location for the mechanical lift linkage 108 that extends from the first portion 104 to the second portion 106, and will be described in further detail below. As shown in FIG. 6, the bottom surface 146 of the seating pan 130 may further include a one or more first brake mounting locations 148 and a one or more second brake mounting locations 150. The one or more first brake mounting locations 148 may include a plurality of apertures 152 located generally above the first aperture 114 in the plate 110, when the seating pan 130 overlies the plate 110. Similarly, the one or more second brake mounting locations 150 may include a plurality of apertures 154 located generally above the second aperture 116 in the plate 110, when the seating pan 130 overlies the plate 110. As will be described in further detail below, a portion of the brake may be mounted to one of the plurality of apertures 152 at the first brake mounting locations 148 and extend downwardly though the first aperture 114 in the plate 110, while in some brake embodiments, a second portion of the brake may be mounted to one of the plurality of apertures 154 at the second brake mounting locations 150 and extend downwardly though the second aperture 116 in the plate 110. Still further, one of the plurality of apertures 154 at the second brake mounting locations 150 may also provide a mounting location for the lift actuator, as will be described below, which extends downwardly from the bottom surface 146 of the seating pan 130 through the second aperture 116 in the plate 110 to mounting support 118 that extends downwardly from the bottom surface 112 of the plate 110 adjacent the second aperture 116. Additionally, one or more cross bars 156 may extend transversely across the bottom surface 146 of the width of the seating pan 130 as to provides addition rigidity to the seating pan 130.

Turning now to the mechanical lift linkage 108, as shown in FIG. 6, rotatably extends between the first portion 104 and the second portion 106 of the lift assembly 102. The linkage 108 includes a symmetrically mirrored first side or subassembly 158 and second side or subassembly 160. Each of the first and second subassemblies 158, 160 includes a first arm 162 that is rotatably affixed at its first end 164 to a first arm mounting location 166 disposed at or near a front end of the raised edge 122, 124 of first portion 104, respectively. The first arm 162 extends upwardly to its opposing second end 168, which is similarly rotatably affixed to a first arm mounting location 170 disposed at or near a front end of the lowered edge 142, 144 of the second portion 106, respectively. As shown in FIGS. 5-7, the first arm mounting location 170 of the second portion 106 is located rearwardly of the first arm mounting location 166 of the first portion 104. More specifically, the first arm mounting location 170 of the second portion 106 is set back a distance of approximately 1.0 cm to 10 cm relative to the first arm mounting location 166 of the first portion 104, and more preferably 5 cm. Accordingly, when the second portion 106 is in an elevated position and the first arm 162 is generally perpendicular to the first portion 104, the raised edge 138 disposed about the front edge of the seating pan 130 will extend forward of the front edge of the pan 110.

Each of the opposing subassemblies 158, 160 of the linkage 108 also include a second arm 172 that is rotatably affixed at its first end 174 to a second arm mounting location 176 at a location along the length of the respective raised edge 122, 124 of first portion 104, that is located rearwardly of the first arm mounting location 166. In one embodiment, as shown in FIGS. 5-7, the second arm mounting location 176 may be set back a distance of approximately 2.5 cm to 30 cm and more preferably 20 cm from a front end of the respective raised edge 122, 124 of first portion 104. The second arm 172 extend to its opposing second end 178, which is similarly rotatably affixed to a second arm mounting location 180 disposed rearwardly along the length of the lowered edge 142, 144 of the second portion 106. As shown in FIGS. 5-7, the second arm 172 had a length that is preferably longer than the length of the first arm 162 so as to tip the seat surface 40, second portion 106 or seating pan 146, forward as the seat rises. By way of non-limiting example, the first arm 162 may have a length of approximately 2 cm to 20 cm, and preferably 10 cm, while the second arm 172 may have a length of approximately 15 cm to 35 cm, and preferably 25 cm. In this illustrated example, the first portion 104 may have a length of approximately 34 cm to 50 cm, and preferably 40 cm, while the second portion 106 may have a length of approximately 34 cm to 50 cm, and preferably 40 cm, in one embodiment, the arms 162, 172 are linear, however, they need not be. For example, one or both or the arms 162, 172 may include a bend or angle along its length, which alters the position of the position of the corresponding second end 168, 178 of the arm 162, 172 during travel.

Additionally, it should be noted that while the opposing subassemblies 158, 160 of the linkage 108 are depicted in FIGS. 5-7 as being formed integrally with the plate 110 of the first portion 104 and the seating pan 130 of the second portion 106, the present invention is not so limited. That is to say that the opposing subassemblies 158, 160 may be discrete structures that are independent of the first portion 104 and/or second portion 106. For example, the opposing subassemblies 158, 160 of the linkage 108 may simply affix to mounting brackets that do not extend transversely across the width of the wheelchair 10, as to accommodate folding of the wheelchair 10 in a conventional manner.

Still referring to FIGS. 2-7, the lift assembly 100 further includes a lift actuator 182, which may be a gas spring 184 including a cylinder 186 and a piston rod 188 extending therefrom. The gas spring 184 provides opposed ends 190 and 192 which are biased to move in separation by a "lifting force" discussed below. Although it should be understood that the present invention may include other forms of lift actuators 182. As shown in FIGS. 5-7, an end 190 of the cylinder 186 of the gas spring 184 is affixed to one of the plurality of apertures 154 at the second brake mounting locations 150 at the bottom surface 146 of the seating pan 130, e.g., second portion 106. The gas spring 184 extends downwardly from the bottom surface 146 of the seating pan 130 through the second aperture 116 in the plate 110 to mounting support 118 that extends downwardly from the bottom surface 112 of the plate 110 adjacent the second aperture 116. The opposing end 192 of the piston rod 188 of the gas spring 184 is affixed to a mounting location 194 along the mounting support 118. In this embodiment, the end 190 of the cylinder 186 may be affixed to a variable position given the plurality of apertures 154 at the second brake mounting locations 150 at the bottom surface 146 of the seating pan 130. In use, movement of the end 190 of the cylinder 186 along the plurality of apertures 154 allows the force exerted on the second portion 106, e.g., seating pan 130, to vary depending upon the mounting location 190. That is to say that the lifting three exerted by the gas spring 184, which in one embodiment may be between 20 lbs. and 200 lbs., and preferably 60 pounds, is generally a predetermined lifting force. However, adjustment of the end 190 of the cylinder 186 along the length of the plurality of apertures 154 may allow a user to vary the force output to the lift assembly 100 via use of the gas spring 184. While not shown, in an alternative embodiment of the present invention, the lift assembly 102 may include a plurality of lift actuators 182, such as the gas spring 184 as described above. In such an embodiment each of the opposing subassemblies 158, 160 of the linkage 108 may be associated with an individual gas spring 184, where the lifting force exerted by each of the two gas springs 184, which in one embodiment may be between 40 lbs. and 120 lbs., is preferably 80 pounds. Such an embodiment may be preferable in the absence of a seating pan 130 and/or plate 110 which transversely extends the width of the wheelchair 10. That is to say that when the opposing subassemblies 158, 160 may be discrete structures that are independent of the first portion 104 and/or second portion 106, each subassembly may comprise an independent mechanical lift actuator 182, as will be described in further detail below.

In addition to the above referenced lift assembly 102, the wheelchair 10 with the lift assist device 100 accordingly to the present embodiment, also includes a brake 196. Returning now to FIGS. 2-4, the brake 196 is shown in further detail including a brake actuator bar 198, in communication with a brake linkage 197 that communicates between the lift assembly 102 and the brake 196 to move the brake 196 from an unlock state to the lock state when the seat surface 40 moves from a lowered position to the elevated position. In one embodiment, the brake linkage 197 includes a lever arm 200, a brake engagement spring 202 and a brake release spring 204. As shown initially in FIG. 2, the brake bar 198 is an elongated bar having a first end 206 that is affixed to and functionally engages the wheel locking bar 206 of the standard wheelchair brake 31 of the first frame subassembly 18, and an opposing second end 210 that is affixed to and functionally engages the wheel locking bar 33 of the standard wheelchair brake 31 of the opposing second frame subassembly 20. That is to say that the brake bar 198 generally extends transversely and spans the width of the wheelchair 10 from one wheelchair brake 31 to the opposing wheelchair brake 31. The lever arm 200 is affixed approximately perpendicularly to the brake bar 198 generally at a midpoint along the length of the brake bar 198. The lever arm 200 includes a first end 212 directed towards the front of the wheelchair 10, and an opposing second end 214 directed towards the rear of the wheelchair 10. The brake engagement spring 202, which may be a coil style tension spring, or any alternative resilient member, extends from the second end 214 of lever arm 200 to one of the plurality of apertures 154 at the second brake mounting locations 150 at the bottom surface 146 of the seating pan 130. The brake release spring 204, which may also be a coil style tension spring, or any alternative resilient member, extends from the opposing first end 212 of the lever arm 200 to one of the plurality of apertures 152 at the first brake mounting locations 148 at the bottom surface 146 of the seating pan 130. During use, as the individual rises from the cushion 136 and/or seating surface 40 the lift assembly 102 extends to both tilt and raise the second portion 106 of the lift assembly 102, e.g., seating pan 130. As the rear portion of the seating pan 130 rises, the brake engagement spring 202 is stressed, exerting an upward pulling force on the rearwardly extending second end 214 of the lever arm 200. This pivoting movement of the lever arm 200 is translated as a torsion or twisting of the brake bar 198. The twisting of the brake bar 198 in turn is extended to the wheel locking bar 33 of the standard wheelchair brake 31 on both the first and second frame subassembly 18, 20; thereby forcing each wheel locking bar 33 to engage with the other surface of each corresponding wheel 12, 14 and lock the wheelchair 10 in a locked state where the rotation of the first and second wheel 12, 14 are blocked with respect to the frame 16. As such, by way of the individual rising from the wheelchair 10, the brake 196 brakes the movement of the wheels 12, 14, as to prevent the wheelchair 10 from undesirably moving or sliding out from under a user that is rising from the wheelchair 10. In one preferred embodiment of the present invention, the seating pan 130 need not travel through its entire range of motion prior to engaging the brake 196. That is to say that at approximately between 3 percent and 20 percent, and more preferably 7 percent of its distance traveled the brake 196 will engage with the wheels 12, 14 via the standard integrated wheelchair brakes 31. This corresponds generally to the seating surface 40 having an inclined angle of approximately between 20 degrees and 50 degrees, and more preferably 40 degrees above horizontal when the brake 196 is engaged. Additionally, with the wheels 12, 14 automatically locked, entering the lock state without the need for the individual's manual activation of the brake, the individual may exert more pushing force on the armrests 38 to further assist in ingress/egress without the wheelchair 10 undesirably moving due to such an applied force on the armrest 38.

In contrast, when a user ingresses the wheelchair 10, which is in the locked state described above, the brake 196 disengages the wheelchair brakes 31. Specifically, the rear of the seating pan 130 retracts downwardly thereby relieving the upward pulling force exerted on the second end 214 of the lever arm 200. Simultaneously, the brake release spring 204 exerts an upward pulling force on the opposing first end 212 of lever arm 200, which forces the front portion of the lever arm 200 upwards. In one embodiment of the present invention, the brake release spring 204 has a spring constant value that is less than that of the brake engagement spring 202. This counter-pivoting movement of the lever arm 200 is translated as a torsion or twisting of the brake bar 198 opposite the direction that had caused engagement of the wheelchair brake 31. The oppositely directed twisting of the brake bar 198 in turn is thereby extended to the wheel locking bar 33 of the standard wheelchair brake 31 on both the first and second frame subassembly 18, 20 thereby releasing each wheel locking bar 33 from engagement with the outer surface of the corresponding wheel 12, 14 and returning the brake to an unlock state thereby allowing rotation of the wheels 12, 14 with respect to the frame 16. As such, by sitting in or ingressing the wheelchair 10, or otherwise exerting a downward force on the seat surface 40 or seat cushion 136, the brake 204 may be disengaged.

It should be further understood that the brake 196 and activation via linkage 197 does not inhibit or otherwise override manual activation of the wheelchair brakes 31. That is to say that an individual may still manually engage the wheelchair brake 31 in the wheelchair 10 including the brake 196 without automatically activating the brake 196 by rising from the seating surface 40. For example, if the wheelchair 10 is resting on an inclined surface with a seated individual, the individual may manually activate the wheelchair brakes 31 without limiting the seat lift assist functionality of the lift assembly 102.

Moreover, it should be understood that the brake 198 is described in detail above is provided as one embodiment of the present invention and that the wheelchair 10 in accordance with the present invention is not so limited. That is to say that the wheelchair 10 may include alternative braking mechanisms functionality as described above.

Additionally, while not shown in FIGS. 2-7, in one embodiment of the present invention, mechanical lift linkage 108 includes a releasable stop to override of the brake 196. For example, activation of the stop is configured to maintain the seating pan 130 is a lowered position, i.e., with the first portion 104 generally contacting the second portion 106, even when an individual is not seated. The seat lock may include a removable pin or similar device which when selectively engaged will prevent the seating pan 130 from rising in the absence of a seated occupant. Engagement of seat lock will similarly inhibit engagement of the brake 196, thereby allowing the wheelchair 10 to be pushed via the handles 34 in the absence of a seated occupant. Alternatively, the wheelchair 10 may include a manual brake override that may inhibit engagement or the brake 196 independent of the orientation of the seating surface 40. Such an override may be operable by an individual that is moving the wheelchair 10 via handles 34 in the absence of a seated occupant. In yet another embodiment, disengagement of such a releasable stop to override of the brake 196 may also reset the brake 196, such that the wheelchair 10 is in a locked state when the releasable stop to override of the brake 196, i.e., brake override, is not engaged. In such an embodiment, a user may engage the releasable stop to override of the brake 196 in an unoccupied wheelchair 10 as to position the wheelchair 10 such that an occupant may ingress, for example next to a bed. With the wheelchair 10 desirably located, the user may disengage the releasable stop to override of the brake 196, thereby automatically engaging the brake 196 such that the movement of the chair will be in a locked state while the occupant ingresses the wheelchair 10, absent any actuation of the brake 196 by either the occupant or the user providing assistance.

Turning now to FIGS. 8-11, an alternative embodiment of the present invention is illustrated providing a wheelchair 10, as described above, that includes a lift assist device 250. Device 250 is similar to the previously described lift assist device 100 in that it also contains a lift assembly 102, with first portion 104, second portion 106, mechanical lift linkage 108, and actuator 182 as described above. However, lift assist device 250 differs from that of device 100 in that includes an alternate embodiment of a brake 252 rather than brake 196, and an alternative embodiment of brake linkage 254 rather than brake linkage 197.

Figure 9:
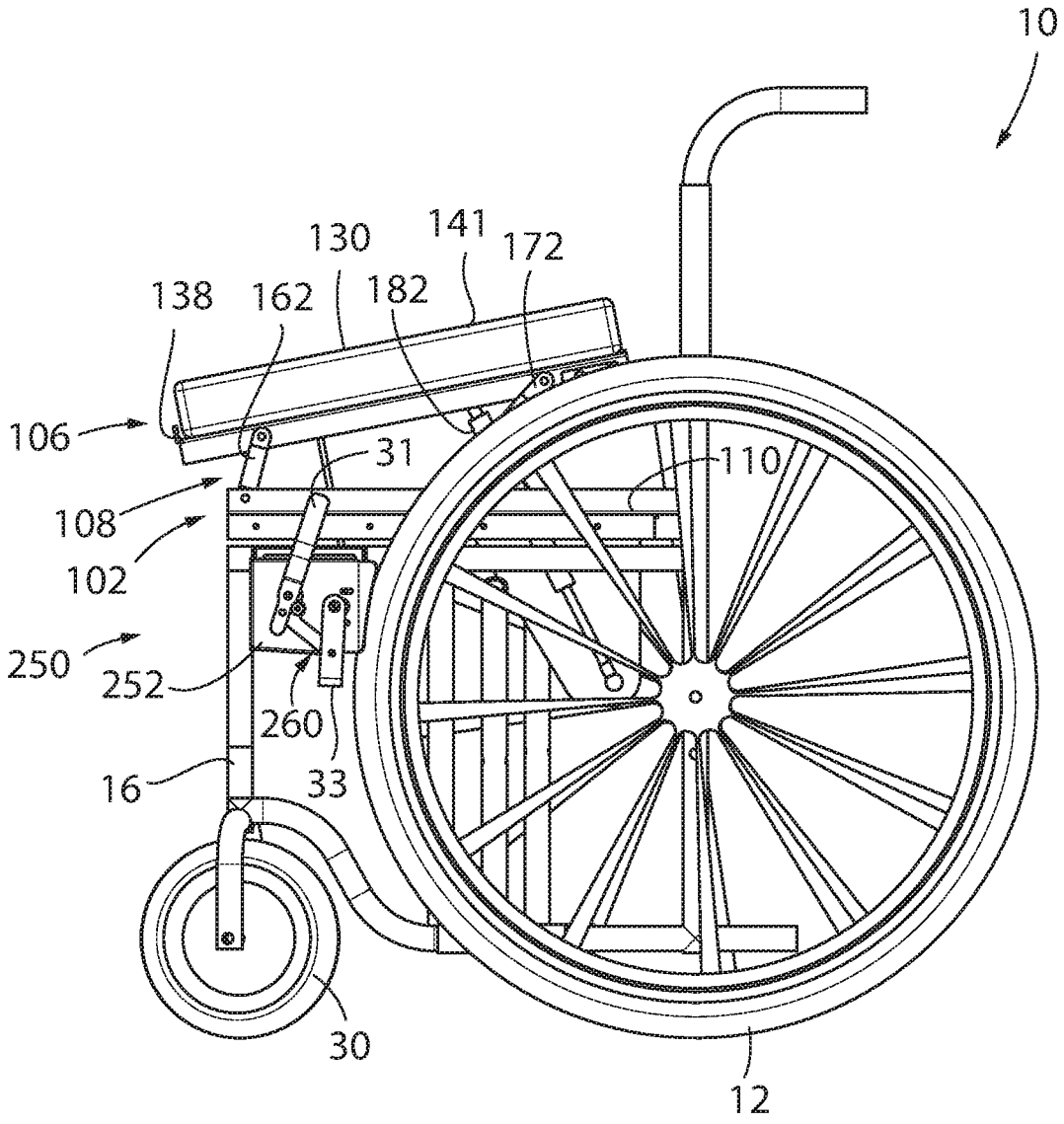
FIG. 9 a side view of the collapsible wheelchair of FIG. 8.
Figure 10:
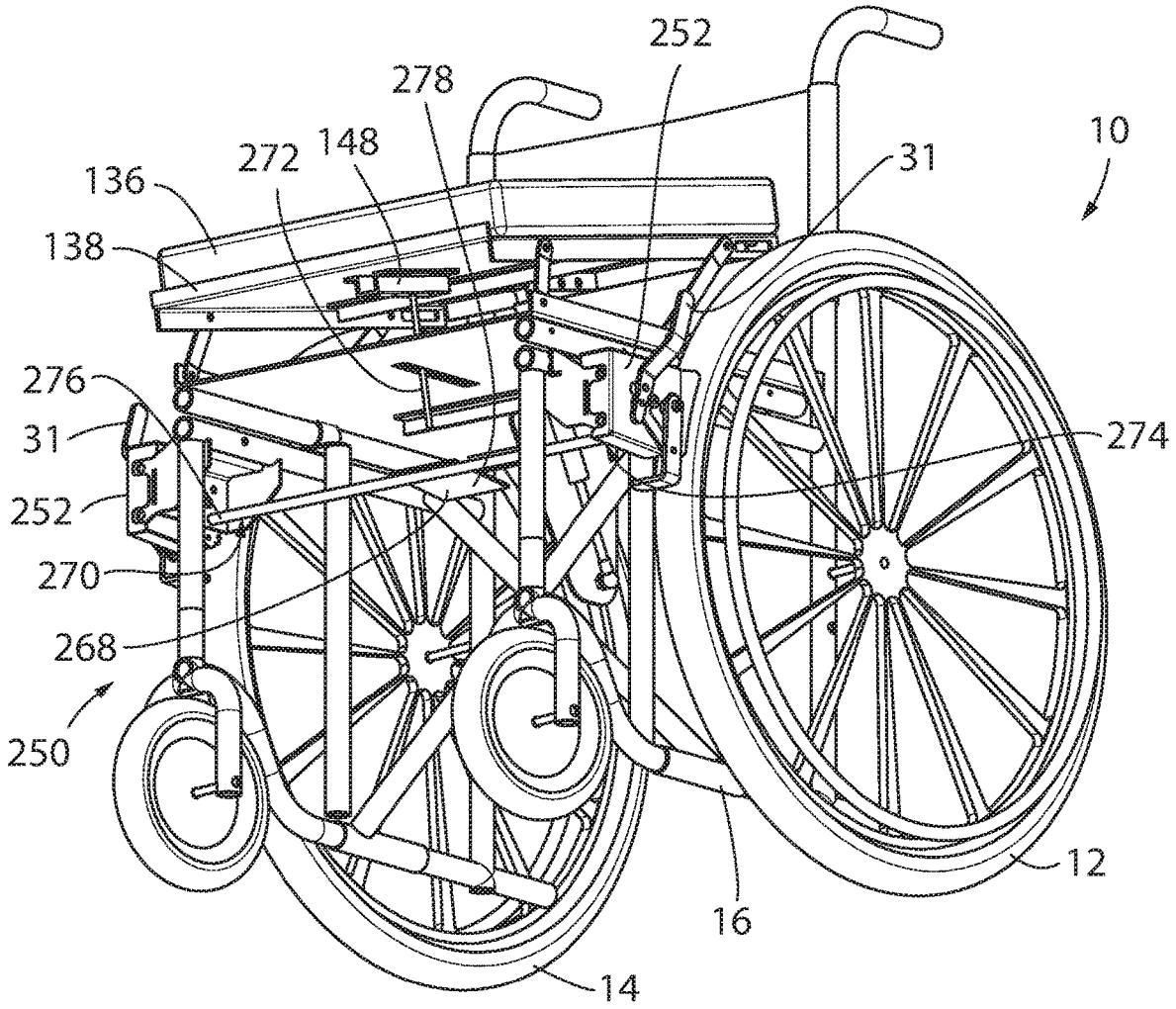
FIG. 10 is a front bottom perspective view of the collapsible wheelchair of FIG. 8.
Figure 11:
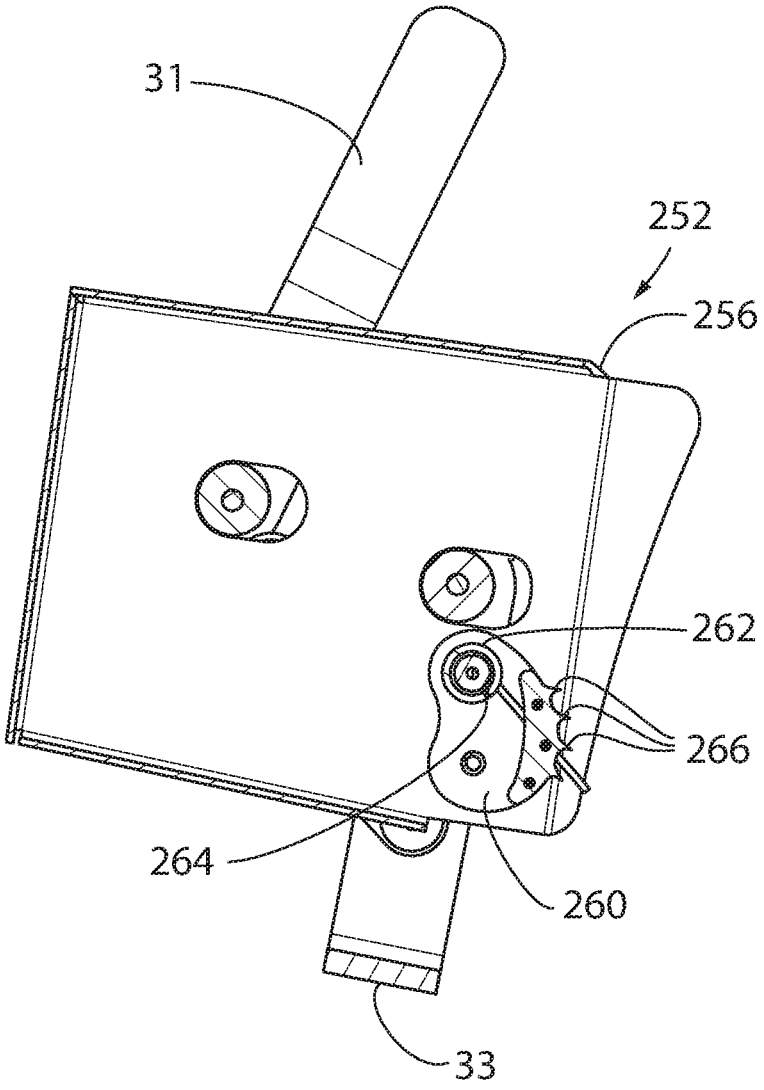
FIG. 11 is a cross-section view of the brake mechanism of FIG. 8.

Still referring to FIGS. 8-11, and particularly FIG. 9, the brake 252 is shown in further detail including a brake housing 256 affixed to each of the first frame subassembly 18 and second frame subassembly 20 at a position adjacent the respective wheel 12, 14. An outer surface 258 of the brake housing may include a standard wheelchair brake 31 affixed thereto, which in use provides for manual control of the locking the rotational movement of the wheels 12, 14 of the wheelchair 10 independent of the state of the brake 252. With reference to FIG. 11, within the housing 256, at least one spring loaded cam 260 is disposed at a rear edge of the housing 256 where the cam 260 is positioned to rotatably engage the corresponding adjacent wheel 12, 14. The spring loaded cam 250 includes a torsion spring 262 disposed about a rotational axis 264 of the cam 260, where the spring force of the torsion spring 262 is configured to bias the cam 260 into contact with the wheel 12, 14. The outer surface of the cam 260 may include a plurality of ridges or knurls 266 that are angled with respect to the surface of the wheel 12, 14 such that the wheel 12, 14 is allowed to rotated the wheelchair 10 forward but not backwards when the brake 252 is in a lock state similar to a single directional ratchet movement. In use, inhibition of rearward movement of the wheelchair 10 when the seating surface 40 is elevated and the brake 252 is in the lock state will prevent the wheelchair 10 from accidentally or undesirably rolling away from the individual that has egressed the wheelchair. However, providing for forward movement of the wheelchair 10 while the brake 252 is in the lock configuration will still along the wheelchair 10 to be pulled towards the knees of the individuals during subsequent ingress into the seating surface 40, thereby further facilitating the ease on ingress.

Referring now to FIG. 10, the brakes 252 are illustrated in communication with a brake linkage 252 that communicates between the lift assembly 102 and the brake 252 to move the brake 252 from an unlock state to the lock state when the seat surface 40 moves from a lowered position to the elevated position. In one embodiment, the brake linkage 252 includes a lever arm or paddle 268, a rotational brake release rod 270 and a brake release pin 272. As shown initially in FIG. 10, the rotational brake release rod 270 is an elongated rod having a first end 274 that is affixed to and rotationally engaged with the rotational axis 264 of the cam 260 in the brake 252 at the first wheel 12, and an opposing second end 276 that is affixed to and rotational engaged with the rotational axis 264 of the cam 260 in the brake 252 at the second wheel 14. That is to say that the rotational brake release rod 270 generally extends transversely and spans the width of the wheelchair 10 from one wheelchair brake 252 to the opposing wheelchair brake 252. The paddle 268 is affixed approximately perpendicularly to the brake release rod 270 generally at a midpoint along the length of the brake release rod 270. The paddle 268 provides a surface 278 that extends rearwardly of the brake release rod 270 towards the rear of the wheelchair 10, and functions as a surface for receiving and engaging the brake release pin 272. The brake release pin 272, which may be formed of a post, rod or similar elongated structure, extends downwardly from one of the plurality of apertures 152 at the first brake mounting locations 148 at the bottom surface 146 of the seating pan 130. Placement of the brake release pin 272 within one of the variable apertures 152 allows for adjustment of the brake linkage 254, as to accommodate installation within wheelchairs 10 of various dimensions, and specifically depths. The opposing end of the brake release pin 272 is positioned above but not affixed to the paddle 268. During use, as the individual rises from the cushion 136 and/or seating surface 40 the lift assembly 102 extends to both tilt and raise the second portion 106 of the lift assembly 102, e.g., seating pan 130. As the seating pan 130 rises, the brake release pin 272 also rises, disengaging from contact with the surface 278 of the paddle 268 and releasing the downward applied force provided by the brake release pin 272. Release of the force provided by the brake release pin 272, releases the rotational force applied by the brake release rod 270 to the rotational axis 264 of the cams 260 in the opposing brakes 252, which had been applied in a direction opposite that of the torsion springs 262. Accordingly, the torsion springs 262 are free to rotate their respective cams 260 into a lock state where the knurls 266 on the outer surface of the cam engage with the surface of the respective wheel 12, 14 to block backward movement of the wheelchair 10 when the seating surface 40 is elevated. As such, by way of the individual rising from the wheelchair 10, the brake 252 brakes the movement of the wheels 12, 14, as to prevent the wheelchair 10 from undesirably moving or sliding out from under a user that is rising from the wheelchair 10. In one preferred embodiment of the present invention, the seating pan 130 need not travel through its entire range of motion prior to engaging the brake 252. That is to say that at approximately between 3 percent and 20 percent, and more preferably 7 percent of its distance traveled the brake 252 will engage with the wheels 12, 14. This corresponds generally to the seating surface 40 having an inclined angle of approximately between 20 degrees and 50 degrees, and more preferably 40 degrees above horizontal when the brake 252 is engaged. Additionally, with the wheels 12, 14 automatically locked, i.e., entering the lock state without the need for the individual's manual activation of the brake 31, the individual may exert more pushing force on the armrests 38 to further assist in ingress/egress without the wheelchair 10 undesirably moving due to such an applied force on the armrest 38.

In contrast, when a user ingress the wheelchair 10, which is in the locked state described above, the brake linkage 254 disengages the wheelchair brakes 252. Specifically, the rear of the seating pan 130 retracts downwardly thereby lowering the release pin 272, forcing it into contact with the surface 278 of the paddle 268 and applying a downward applied force thereon. Application of the force provided by the brake release pin 272, is translated to a rotational force applied by the brake release rod 270 and to the rotational axis 264 of the cams 260 in the opposing brakes 252, which is applied in a direction opposite that of the torsion springs 262. Accordingly, the spring force applied by the torsion springs 262 is overcome and the respective cams 260 are rotated into an unlock state where the knurls 266 on the outer surface of the cam 260 disengage with the surface of the respective wheel 12, 14 to allow movement of the wheelchair 10 when the seating surface 40 is lowered. As such, by sitting in or ingressing the wheelchair 10, or otherwise exerting a downward force on the seat surface 40 or seat cushion 136, the brake 252 may be disengaged.

It should be further understood that the brake 252 and activation via brake linkage 254 does not inhibit or otherwise override manual activation of the wheelchair brakes 31. That is to say that an individual may still manually engage the wheelchair brake 31 in the wheelchair 10 including the brake 252 without automatically activating the brake 252 by rising from the seating surface 40. For example, if the wheelchair 10 is resting on an inclined surface with a seated individual, the individual may manually activate the wheelchair brakes 31 without limiting the seat lift assist functionality of the lift assembly 102.

Moreover, it should be understood that the brake 252 is described in detail above is provided as one embodiment of the present invention and that the wheelchair 10 in accordance with the present invention is not so limited. That is to say that the wheelchair 10 may include alternative braking mechanisms functionality as described above.

Figure 12:
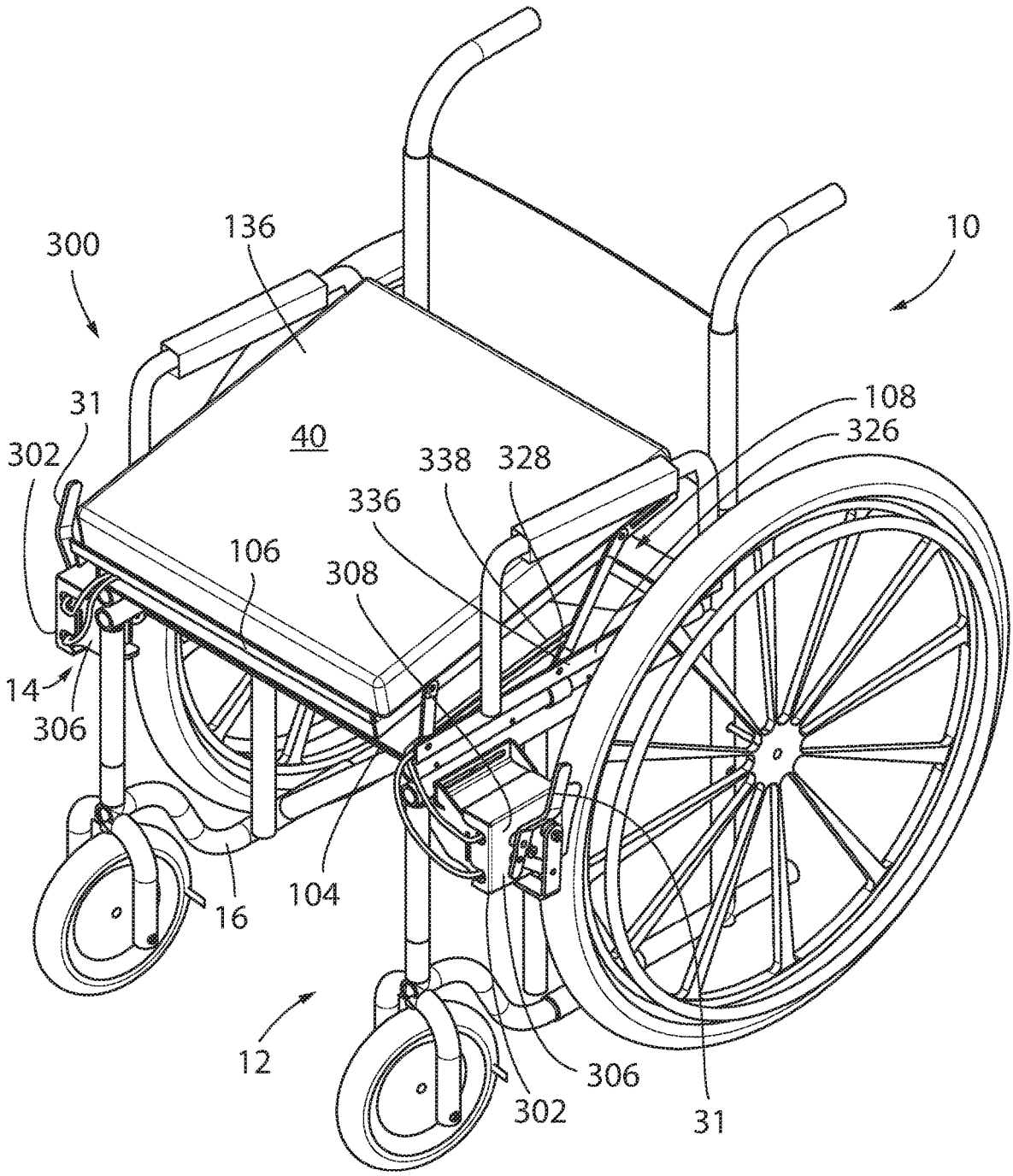
FIG. 12 is a front side perspective view of a collapsible wheelchair in accordance with one alternative embodiment of the present invention shown in FIG. 1 with a seating surface and lift assembly in an elevated position and a brake mechanism engaging the wheels of the wheelchair.
Figure 13:
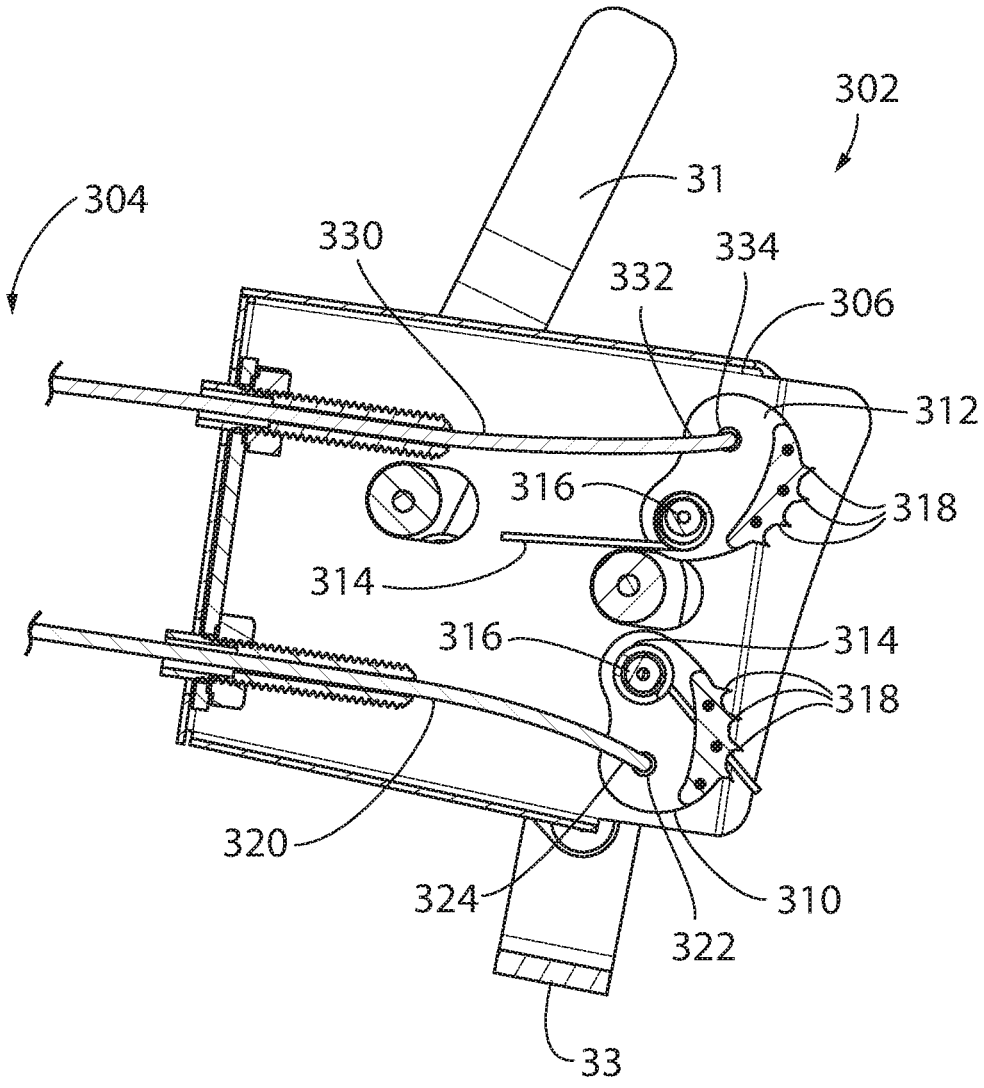
FIG. 13 is a cross-section view of the brake mechanism of FIG. 12.

Turning now to FIGS. 12 and 13, another alternative embodiment of the present invention is illustrated providing a wheelchair 10, as described above, that includes a lift assist device 300. Device 300 is similar to the previously described lift assist device 250 in that it also contains a lift assembly 102, with first portion 104, second portion 106, mechanical lift linkage 108, and actuator 182 as described above. However, lift assist device 300 differs from that of device 250 in that includes an alternate embodiment of a brake 302 rather than brake 252, and an alternative embodiment of brake linkage 304 rather than brake linkage 254.

Still referring to FIGS. 12 and 13, the brake 302 is shown in further detail including a brake housing 306 affixed to each of the first frame subassembly 18 and second frame subassembly 20 at a position adjacent the respective wheel 12, 14. An outer surface 308 of the brake housing may include a standard wheelchair brake 31 affixed thereto, which in use provides for manual control of the locking the rotational movement of the wheels 12, 14 of the wheelchair 10 independent of the state of the brake 302. With reference to FIG. 13, within the housing 306, a first spring loaded cam 310 and a second spring loaded cam 312 are disposed at a rear edge of the housing 306 where the cams 310, 312 are positioned to rotatably engage the corresponding adjacent wheel 12, 14. Each of the spring loaded cams 310, 312 includes a torsion spring 314 disposed about a rotational axis 316 of the respective cam 310, 312 where the spring force of the torsion spring 314 is configured to bias the cam 310, 312 into contact with the wheel 12, 14. The outer surface of each cam 310, 312 may include a plurality of ridges or knurls 318 that are angled with respect to the surface of the wheel 12, 14 such that the wheel 12, 14 is allowed to rotated the wheelchair 10 in one direction but not the other when the brake 302 is in a lock state similar to a single directional ratchet movement. More specifically, cam 310 is positioned similar to cam 260 of brake 252, in that it inhibits rearward movement of the wheelchair 10 when in a lock state, but does not inhibit forward movement. Cam 312 is positioned opposite of cam 310, in that it in that it inhibits forward movement of the wheelchair 10 when in a lock state, but does not inhibit rearward movement. In combination, activation of both cams 310, 312 in the lock state blocks both forward and backward movement of the wheelchair 10. Accordingly, in use, inhibition of forward and backward movement of the wheelchair 10 when the seating surface 40 is elevated and the brake 302 is in the lock state will prevent the wheelchair 10 from accidentally or undesirably rolling away from the individual that has egressed the wheelchair.

Still referring to FIG. 13, the brakes 302 are illustrated in communication with a brake linkage 304 that communicates between the lift assembly 102 and the brake 302 to move the brake 302 from an unlock state to the lock state when the seat surface 40 moves from a lowered position to the elevated position. In one embodiment, the brake linkage 304 includes a first cable 320, such as a bowden cable, that extends from a first end 322 affixed to a mounting location 324 on the first cam 310 to an opposing second end 326 affixed to a mounting location 328 at the mechanical linkage 108 of the lift assembly 102. The brake linkage 304 also includes a second cable 330, such as a bowden cable, that extends from a first end 332 affixed to a mounting location 334 on the second cam 312 to an opposing second end 336 affixed to a mounting location 338 at the mechanical linkage 108 of the lift assembly 102.

During use, as the individual rises from the cushion 136 and/or seating surface 40 the lift assembly 102 extends to both tilt and raise the second portion 106 of the lift assembly 102, e.g., seating pan 130. As the seating pan 130 rises, the mechanical linkage 108 of the lift assembly 102 rises along with the mounting locations 328, 338 for the respective second ends 326, 336 of the first and second cables 320, 330. The upward movement of the mechanical linkage 108 of the lift assembly 102 releases a tension force on the cables 320, 330. Release of the force provided by the cables 320, 330 in turn is translated to a release of the opposing force applied by the cables 320, 330 to the mounting locations 324, 334 on the respective cams 310, 312. Release of the force from the cables 320, 330 which had been applied in a direction opposite that of the torsion springs 314 allows the torsion springs 314 to freely bias their respective cams 310, 312 into a lock state where the knurls 318 on the outer surface of the cams 310, 312 engage with the surface of the respective wheel 12, 14 to block forward and backward movement of the wheelchair 10 when the seating surface 40 is elevated. As such, by way of the individual rising from the wheelchair 10, the brake 302 brakes the movement of the wheels 12, 14, as to prevent the wheelchair 10 from undesirably moving or sliding out from under a user that is rising from the wheelchair 10. In one preferred embodiment of the present invention, the seating pan 130 need not travel through its entire range of motion prior to engaging the brake 302. That is to say that at approximately between 3 percent and 20 percent, and more preferably 7 percent of its distance traveled the brake 302 will engage with the wheels 12, 14. This corresponds generally to the seating surface 40 having an inclined angle of approximately between 20 degrees and 50 degrees, and more preferably 40 degrees above horizontal when the brake 302 is engaged. Additionally, with the wheels 12, 14 automatically locked, i.e., entering the lock state without the need for the individual's manual activation of the brake 31, the individual may exert more pushing force on the armrests 38 to further assist in ingress/egress without the wheelchair 10 undesirably moving due to such an applied force on the armrest 38.

In contrast, when a user ingress the wheelchair 10, which is in the locked state described above, the brake linkage 304 disengages the wheelchair brakes 302. Specifically, the rear of the seating pan 130 retracts downwardly thereby lowering the mechanical linkage 108 of the lift assembly 102 along with the mounting locations 328, 338 for the respective second ends 326, 336 of the first and second cables 320, 330. The downward movement of the mechanical linkage 108 of the lift assembly 102 increases a tension force on the cables 320, 330. Increase of the force provided by the cables 320, 330 in turn is translated to an applied opposing force by the cables 320, 330 to the mounting locations 324, 334 on the respective cams 310, 312. Applying force from the cables 320, 330 in a direction opposite that of the torsion springs 314 overcomes the spring force of the torsion springs 314 and rotates the respective cams 310, 312 into a unlock state where the knurls 318 on the outer surface of the cams 310, 312 disengage with the surface of the respective wheel 12, 14 to allow forward and backward movement of the wheelchair 10 when the seating surface 40 is lowered. As such, by sitting in or ingressing the wheelchair 10, or otherwise exerting a downward force on the seat surface 40 or seat cushion 136, the brake 302 may be disengaged.

It should be further understood that the brake 302 and activation via brake linkage 304 does not inhibit or otherwise override manual activation of the wheelchair brakes 31. That is to say that an individual may still manually engage the wheelchair brake 31 in the wheelchair 10 including the brake 252 without automatically activating the brake 252 by rising from the seating surface 40. For example, if the wheelchair 10 is resting on an inclined surface with a seated individual, the individual may manually activate the wheelchair brakes 31 without limiting the seat lift assist functionality of the lift assembly 102.

Moreover, it should be understood that the brake 302 is described in detail above is provided as one embodiment of the present invention and that the wheelchair 10 in accordance with the present invention is not so limited. That is to say that the wheelchair 10 may include alternative braking mechanisms functionality as described above.

Figure 14:
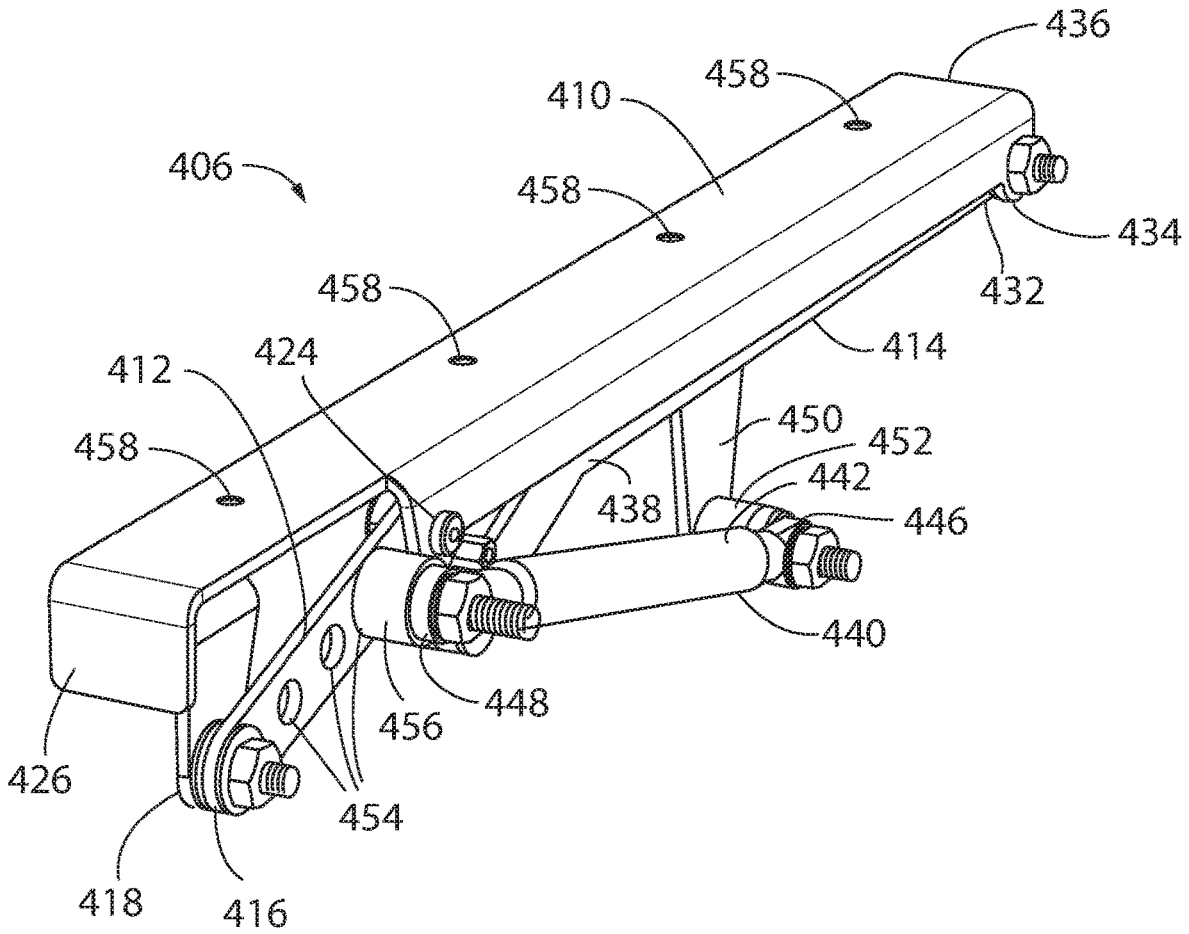
FIG. 14 is front side perspective view of one lift subassembly according to an alternative embodiment of the present invention, with the lift subassembly in a lowered orientation.
Figure 15:
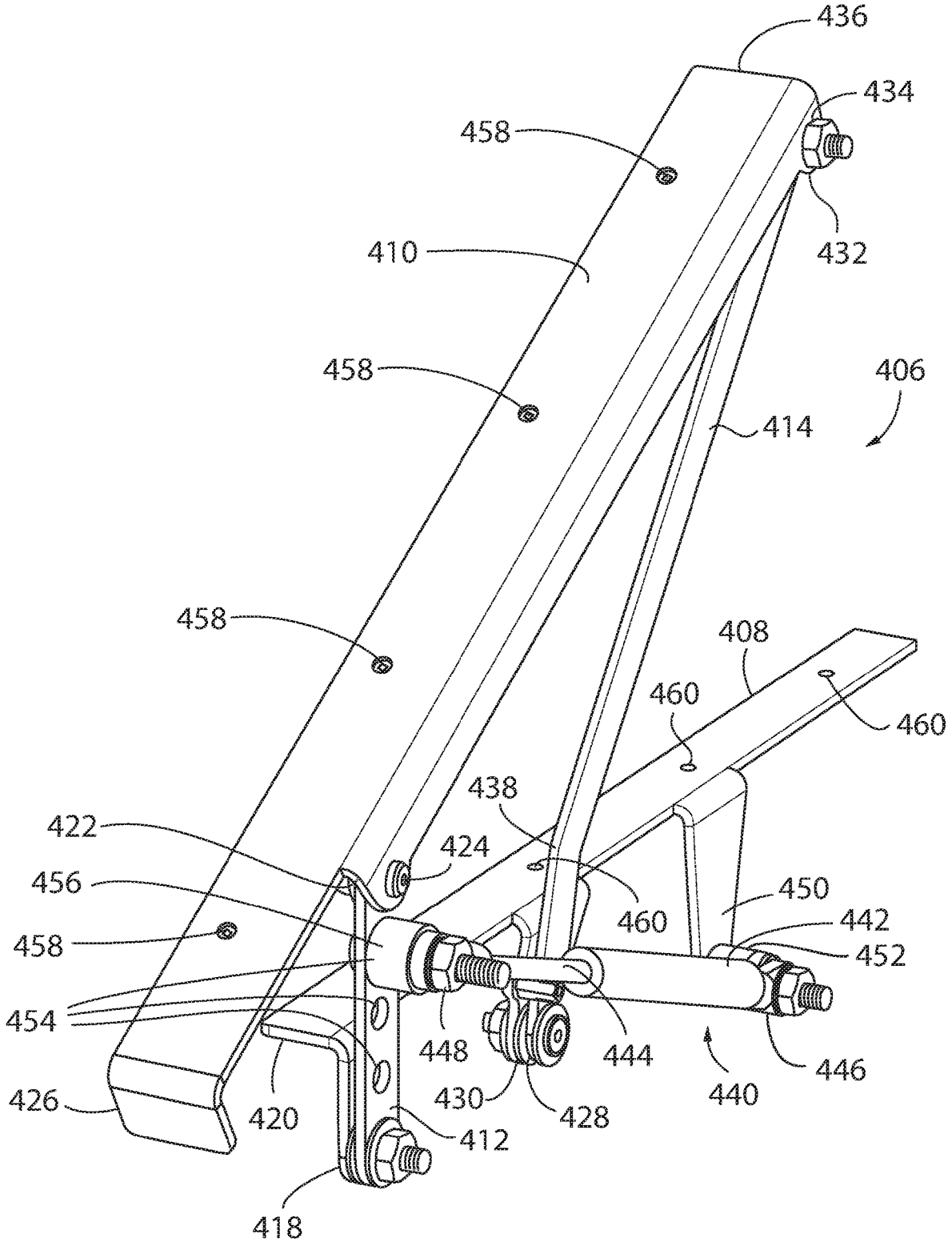
FIG. 15 is a front and side perspective view of the lift subassembly of FIG. 14, with the lift subassembly in an elevated orientation.

Turning now to FIGS. 14 and 15, yet another alternative embodiment of the present invention is illustrated in which an alternative lift assist device 400 may include a lift assist assembly 402 that is formed of two discrete subassemblies that do not extend transversely across the width of the wheelchair 10. That is to say that the lift assist assembly 402 is formed of a first lift subassembly 404 that is generally positioned between the frame 16 of the wheelchair 10 and the seat surface 40 at the first side frame subassembly 18 adjacent the first wheel 12 and a second lift subassembly 406 that is generally positioned between the frame 16 of the wheelchair 10 and the seat surface 40 at the second side frame subassembly 20 adjacent the second wheel 14. The seat surface 40 may then extend from the first lift subassembly 404 to the second lift subassembly 406, and in one embodiment may be releasably extendable between the first and second lift subassemblies 404, 406 as to maintain the collapsibility of the wheelchair 10. Alternatively, the seats surface 40 may be a sling style seat or similarly pliable constructions as to maintain the collapsibility of the wheelchair 10 without removal of the seat surface 40. While FIGS. 14 and 15 illustrate an embodiment of the second lift subassembly 406, it should be understood that the first and second lift subassemblies 404, 406 are mirror images of one another and that the following identified features of the second lift subassembly 406 also applies to the first lift subassembly 404. It should be understood that while FIGS. 14 and 15 show one illustrated embodiment of the second lift subassembly 406, the present invention is not so limited, and other lift subassemblies, namely the first lift subassembly 404, are considered within the scope of the present invention.

Each of the first and second lift subassemblies 404, 406 includes a first portion 104 defined by a first bracket 408 that will extend generally horizontally when attached to the frame 16 of the wheelchair 10, second portion 106 defined by a movable second bracket 410 that will be attached to the seat surface 40 and will elevate relative to the first bracket 408 and tip forward, and a mechanical lift linkage 108 defined by a first arm 412 and second arm 414 that each extend between the first and second brackets 408, 410 and are pivotably attached to the first and second bracket 408 and 410 to provide a four bar linkage. Specifically, the first arm 412 is rotatably affixed at its first end 416 to a first mounting location 418 disposed at or near a front end 420 of the first bracket 408. The first arm 412 extends to its opposing second end 422, which is similarly affixed to a first mounting location 424 of the second bracket 410. As shown in FIG. 14, the first mounting location 424 of the second bracket 410 is located rearwardly of the first mounting location 418 of the first bracket 408. That is to say that the first mounting location 424 of the second bracket 410 is not located at a first end 426 of the second bracket 410 but is rather set back a distance of approximately 2.5 cm to 20 cm, and more preferably 10 cm from the first end 426 of the second bracket 410.

The second arm 414 is rotatably affixed at its first end 428 to a second mounting location 430 at a location along the length of the first bracket 408 that is located rearwardly of the first mounting location 418. In one embodiment, as shown in FIG. 15, the second mounting location 430 of the first bracket 408 may be set back a distance of approximately 2.5 cm to 20 cm and more preferably 10 cm from a first end 420 of the first bracket 408. The second arm 414 extend to its opposing second end 432, which is similarly affixed to a second mounting location 434 disposed at a rear end 436 of the second bracket 410. As shown in FIG. 15, the second arm 414 had a length that is preferably longer than the length of the first arm 412 so as to tip the seat surface 40 forward as the seat surface 40 rises. By way of non-limiting example, the first arm 412 may have a length of approximately 2 cm to 20 cm, and preferably 10 cm, while the second arm 414 may have a length of approximately 15 cm to 35 cm, and preferably 25 cm. In this illustrated example, the first bracket 408 may have a length of approximately 34 cm to 50 cm, and preferably 40 cm, while the second bracket 410 may have a length of approximately 34 cm to 50 cm, and preferably 40 cm. As shown in FIG. 15, the arms 412, 414 need not be linear. For example, as shown in FIG. 15, the second arm 414 may include a bend or angle 438 along its length, which alters the position of the position of the second end 432 of the second arm 414 during travel, as described in further detail below. Additionally, it should be noted that while the brackets 408, 410 are depicted in FIGS. 14 and 15 as relatively flat plates with the mounting locations 418, 424, 430, 434 extending downwardly at a generally perpendicular angle to the relative plane of the brackets 408, 410, the present invention is not so limited. That is to say that the brackets 408, 410 and mounting locations 418, 424, 430, 434 may be formed of other shapes and configurations.

Still referring to FIG. 15, each of the first and second lift subassemblies 404, 406 further includes a mechanical lift actuator 182, which may be a gas spring 440 including a cylinder 442 and a piston rod 444 extending therefrom. The gas spring 442 provides opposed ends 446 and 448 which are biased to move in separation by a "lifting force" discussed below. Although it should be understood that the present invention may include other forms of mechanical lift actuators 180. As shown in FIG. 15, the end 446 of the cylinder 442 of the gas spring 440 is affixed to a third mounting location 450 on the first bracket 408 that is located rearwardly of the first mounting location 418 and second mounting location 430. In one embodiment, as shown in FIG. 15, the third mounting location 450 of the first bracket 408 may be set back a distance of approximately 15 cm to 35 cm and more preferably 25 cm from a first end 420 of the first bracket 408. A spacer 452 may offset the end 446 of the cylinder 442 of the gas spring 440 from the side of the mounting location 450 to provide clearance to accommodate the movement of the arms 412, 414. The opposing end 448 of the piston rod 444 of the gas spring 440 is affixed to a variable mounting location 454 along the length of the first arm 412. That is to say that the end 194484 of the piston rod 444 may be affixed to a position along the length of the first arm 412. As shown in FIG. 15, the length of the first arm 412 may include a series of variable mounting locations 454, i.e., apertures. In use, movement of the end 448 of the piston rod 444 along the length of the first arm 412 allows the force exerted on the first arm 412 to vary depending upon the mounting location 454. That is to say that the lifting force exerted by the gas spring 440, which in one embodiment may be between 40 lbs. and 140 lbs., and preferably 80 pounds, in each of the first and second lift subassemblies 404, 406 is generally a predetermined lifting force. However, adjustment of the end 448 of the piston rod 444 along the length of the first arm 454 may allow a user to vary the force output to the first and second lift subassemblies 404, 406 via use of the gas spring 440. Again, a spacer 456 may offset the end 448 of the piston rod 444 of the gas spring 440 from the side of the mounting location 454 to provide clearance from the movement of the arms 412, 414.

Still referring to FIGS. 14 and 15, when the gas spring 440 has extended its length to pivot the arms 412, 414 and tilt the second bracket 410 forward and upwards relative to the position of the first bracket 408 the travel of the gas spring 440, arms 412, 414 and second bracket 410 is limited by the length of the piston arm 444. This lifted or extending orientation illustrates the position of the lift subassemblies 404, 406 in the absence of an individual sitting on the wheelchair 10. In one embodiment of the present invention, the second bracket 410 of the lift subassemblies 404, 406, and the seat surface 40, which may be affixed to the second bracket 410 by way of mounting hardware (not shown) that passes through mounting apertures 458 in the surface of the second bracket 410 that is configured to be mounted there on may travel to an inclined angle of approximately between 20 degrees and 60 degrees, and more preferably 40 degrees from a resting position shown in FIG. 15. Similar mounting apertures 460 are disposed along the length of the of the first bracket 408, such the first bracket may be affixed to the frame 16 of the wheelchair 10. Additionally, the first end 426 of the second bracket 410 of the lift subassemblies 404, 406 may be elevated to a height of approximately between 4 cm and 10 cm, and more preferably 6 cm above the first bracket 408, when in the fully extended orientation. Similarly, the opposing second end 436 of the second bracket 410 of the lift subassemblies 404, 406 may be elevated to a height of approximately between 18 cm and 30 cm, and more preferably 22 cm above the first bracket 408, when in the fully extended orientation.

Figure 16:
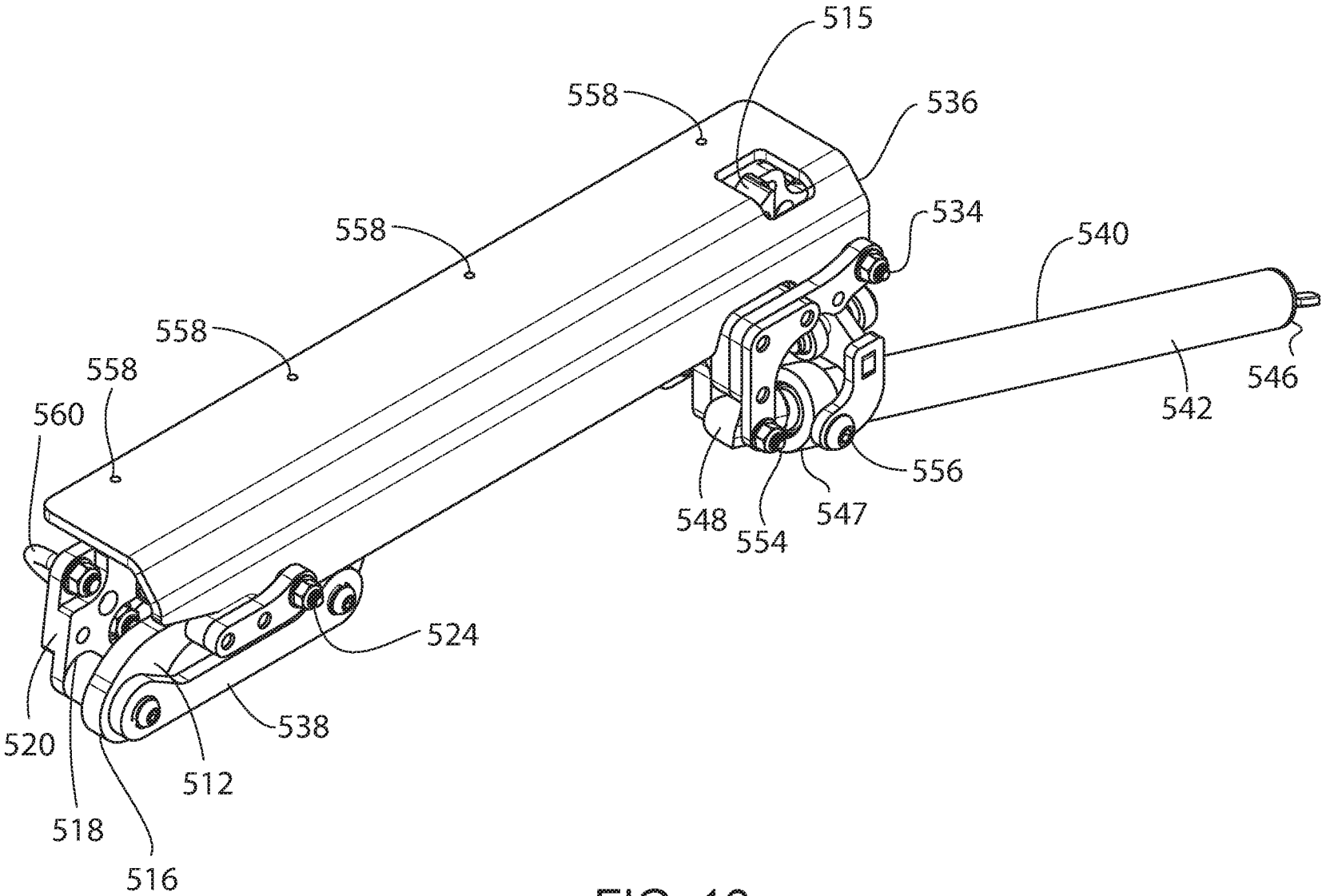
FIG. 16 is top side perspective view of one lift subassembly according to another alternative embodiment of the present invention, with the lift subassembly in a lowered orientation; and, FIG. 17 is a bottom side perspective view of the lift subassembly of FIG. 17, with the lift subassembly in a lowered orientation.
Figure 17:
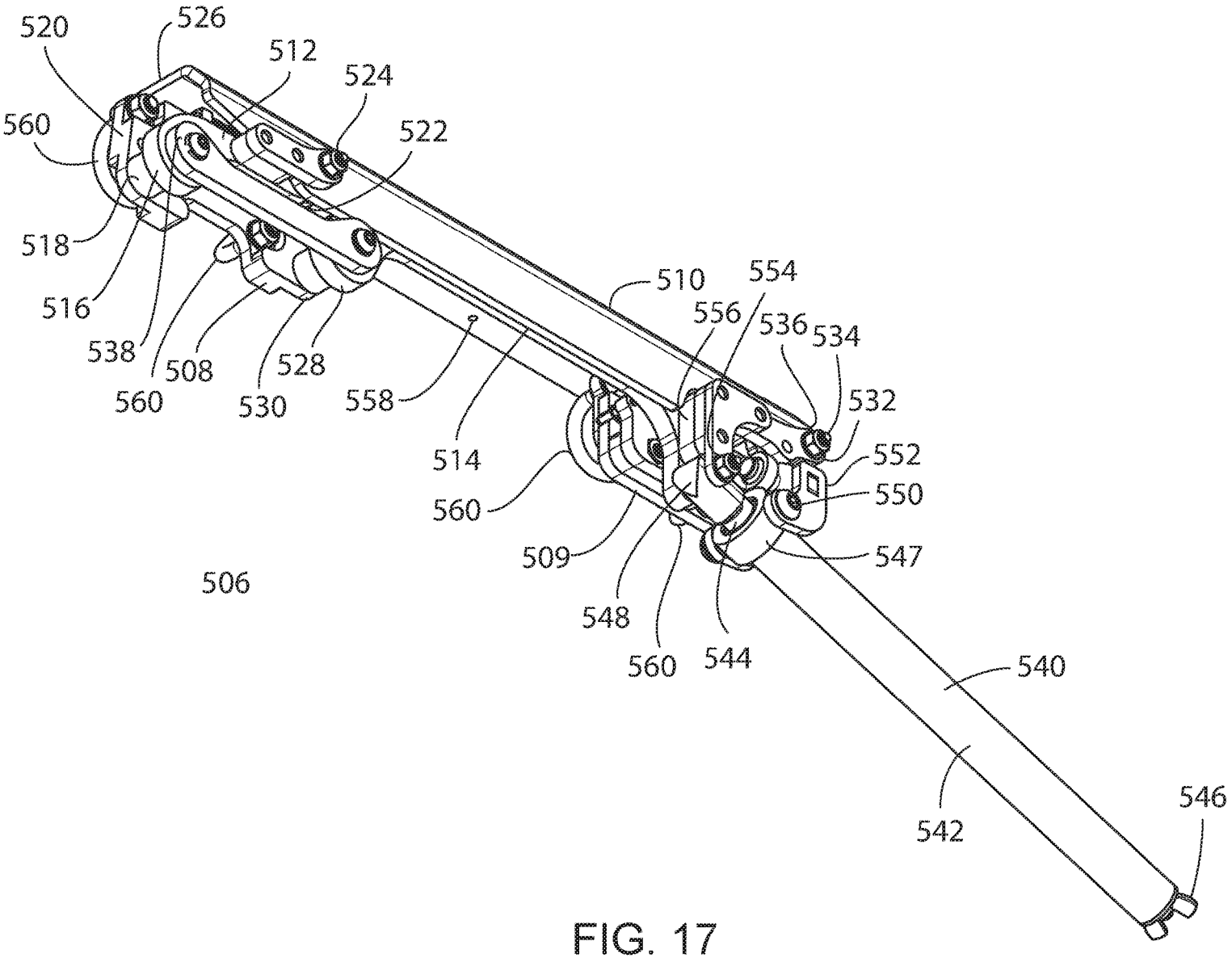

Turning now to FIGS. 16 and 17, yet another alternative embodiment of the present invention is illustrated in which an alternative lift assist device 500 may include an alternative embodiment of the lift assist assembly 502 that is formed of two discrete subassemblies that do not extend transversely across the width of the wheelchair 10. That is to say that the lift assist assembly 502 is formed of a first lift subassembly 504 that is generally positioned between the frame 16 of the wheelchair 10 and the seat surface 40 at the first side frame subassembly 18 adjacent the first wheel 12 and a second lift subassembly 506 that is generally positioned between the frame 16 of the wheelchair 10 and the seat surface 40 at the second side frame subassembly 20 adjacent the second wheel 14. In this manner, the lift assist assembly 502 is similar to the lift assist assembly 402 described above, in that each subassembly 504, 506 includes a first portion 104, second portion 106, mechanical lift linkage 108 and actuator 180. However, lift assist assembly 502 differs in the nature of its components and their interactions as described in further detail below.

Still referring to FIGS. 16 and 17, each of the mirror image first and second lift subassemblies 504, 506, of which only the second lift subassembly 506 is shown, includes a first portion 104 defined by a first front bracket 508 and a first rear bracket 509 that each extend generally horizontally when independently attached to the frame 16 of the wheelchair 10, second portion 106 defined by a movable second bracket 510 that will be attached to the seat surface 40 and will elevate relative to the first front and rear brackets 508, 509 and tip forward, and a mechanical lift linkage 108 defined by a first arm 512 and second arm 514 that each extend between the first front bracket and second brackets 508, 510, and are pivotably attached to the first front bracket and second brackets 508, 510 to provide a four bar linkage. Specifically, the first arm 512 is rotatably affixed at its first end 516 to a first mounting location 518 disposed at or near a front end 520 of the first front bracket 508. The first arm 512 extends to its opposing second end 522, which is similarly affixed to a first mounting location 524 of the second bracket 510. As shown in FIG. 17, the first mounting location 524 of the second bracket 510 is located rearwardly of the first mounting location 518 of the first front bracket 508. That is to say that the first mounting location 524 of the second bracket 510 is not located at a first end 526 of the second bracket 510 but is rather set back a distance of approximately 2.5 cm to 20 cm, and more preferably 10 cm from the first end 526 of the second bracket 510.

The second arm 514 is rotatably affixed at its first end 528 to a second mounting location 530 at a location along the length of the first front bracket 508 that is located rearwardly of the first mounting location 518. In one embodiment, as shown in FIG. 17, the second mounting location 530 of the first front bracket 508 may be set back a distance of approximately 2.5 cm to 20 cm and more preferably 10 cm from a first end 520 of the first front bracket 508. The second arm 514 extend to its opposing second end 532, which is similarly affixed to a second mounting location 534 disposed at a rear end 536 of the second bracket 510. As shown in FIG. 17, the second arm 514 had a length that is preferably longer than the length of the first arm 512 so as to tip the seat surface 40 forward as the seat surface 40 rises. By way of non-limiting example, the first arm 512 may have a length of approximately 2 cm to 20 cm, and preferably 10 cm, while the second arm 514 may have a length of approximately 15 cm to 35 cm, and preferably 25 cm. In this illustrated example, the first front bracket 508 may have a length of approximately 5 cm to 25 cm, and preferably 12 cm, while the second bracket 510 may have a length of approximately 34 cm to 50 cm, and preferably 40 cm. As shown in FIG. 17, the arms 512, 514 may be further secured to the first front bracket 508 by a brace 538 that extends between the first mounting location 518 and second mounting location 530 inward of the arms 512, 514. In this configuration, the rotatable mounting of the arms 512, 514 are sandwiched between the first front bracket 508 and the brace 530. Additionally, it should be noted that while the brackets 508, 510 are depicted in FIGS. 16 and 17 as relatively flat plates with the mounting locations extending perpendicularly therefrom, the present invention is not so limited. That is to say that the brackets 508, 510 may be formed of other shapes and configurations.

Still referring to FIG. 17, each of the first and second lift subassemblies 504, 506 further includes a mechanical lift actuator 180, which may be a gas spring 540 including a cylinder 542 and a piston rod 544 extending therefrom. The gas spring 542 provides opposed ends 546 and 548 which are biased to move in separation by a "lifting force" discussed below. Although it should be understood that the present invention may include other forms of mechanical lift actuators 180. As shown in FIG. 17, the end 546 of the cylinder 542 of the gas spring 540 extend rearwardly of the subassembly 506, while the collar 547 of the cylinder 542 is affixed to a third mounting location 550 on the first rear bracket 509 that is located rearwardly of the first mounting location 518 and second mounting location 530 of the first front bracket 508. In one embodiment, as shown in FIG. 17, the third mounting location 550 of the first rear bracket 509 may be set back a distance of approximately 15 cm to 35 cm and more preferably 25 cm from a first end 520 of the first front bracket 508, and generally at the rear end 552 of the first rear bracket 509. The opposing end 548 of the piston rod 544 of the gas spring 540 is affixed to a mounting location 554 along the length of the second arm 514. In use, movement of the end 548 of the piston rod 544 exerts a pushing force on the second arm 512. In one embodiment, the force exerted by the gas spring 540, which in one embodiment may be between 40 lbs, and 140 lbs., and preferably 80 pounds, in each of the first and second lift subassemblies 404, 406 is generally a predetermined lifting force. A spacer 556 may offset the end 548 of the piston rod 544 of the gas spring 540 from the side of the mounting location 554 to provide clearance from the movement of the second arm 514.

Referring to FIG. 16, in one embodiment, the first rear bracket 509 may further include releasable stop such as a latch 515 that selectively engages with a pin (not shown) extending from the second arm 514 of the mechanical linkage. When the pin is receiving in the latch 515, the second bracket 510 of second portion 108 and thereby the seat surface 40 is maintained in the lowered position with respect to the frame 16 of the wheelchair 10 in the absence of the seated individual. That is to say that engagement of the latch 515 may override the brake mechanism as described above and allow the first and second wheels to rotate absent a seated individual. In an alternative embodiment, the releasable stop may be configured to override the brake mechanism independent of the location of the seating surface 40, such that the wheelchair 10 can be pushed to a desire location regardless of the presence or absence of a rider.

Still referring to FIGS. 16 and 17, when the gas spring 540 has extended its length to pivot the arms 512, 514 and tilt the second bracket 510 forward and upwards relative to the position of the first front and rear brackets 508, 509 the travel of the gas spring 540, arms 512, 514 and second bracket 610 is limited by the length of the piston arm 544, or arms 512, 514. Such a lifted or extending orientation represents the position of the lift subassemblies 504, 506 in the absence of an individual sitting on the wheelchair 10. In one embodiment of the present invention, the second bracket 510 of the lift subassemblies 504, 506, and the seat surface 40, which may be affixed to the second bracket 510 by way of mounting hardware (not shown) that passes through mounting apertures 558 in the surface of the second bracket 510 that is configured to be mounted thereon may travel to an inclined angle of approximately between 20 degrees and 60 degrees, and more preferably 40 degrees from a resting position shown in FIG. 17. Similarly, the first front and rear brackets 508, 509 may be affixed along the length of either the second tube 26, or where applicable the third tube 28 of the frame 16 of the wheelchair 10 by a series of laterally extending clamps 560 are disposed along the length of the of the first front and second brackets 508, 509. Such clamps 560 are particularly well suited for the installation of the lift assist device 500 as a kit to retrofit on an existing wheelchair 10.

Additionally, the first end 526 of the second bracket 510 of the lift subassemblies 504, 506 may be elevated to a height of approximately between 4 cm and 10 cm, and more preferably 6 cm above the first bracket 508, when in the fully extended orientation. Similarly, the opposing second end 536 of the second bracket. 510 of the lift subassemblies 404, 406 may be elevated to a height of approximately between 18 cm and 30 cm, and more preferably 22 cm above the first rear bracket 509, when in the fully extended orientation.

Many other changes and modifications could be made to the invention without departing from the spirit thereof. It should be understood that the invention is not limited in its application to the details of construction and arrangements of the components set forth herein. The invention is capable of other embodiments and of being practiced or carried out in various ways. Variations and modifications of the foregoing are within the scope of the present invention. It also being understood that the invention disclosed and defined herein extends to all alternative combinations of two or more of the individual features mentioned or evident from the text and/or drawings. All of these different combinations constitute various alternative aspects of the present invention.

We claim:

1. A wheelchair including a wheelchair lift assembly configured to assist an individual sitting into and/or rising from a wheelchair, comprising:

a frame providing a seat surface configured for supporting a seated individual;

a first and second wheel attached to the frame at left and right transversely opposed sides of the seat surface supporting the frame and positioned for rotation by the seated individual;

the lift assembly positioned between the seat surface and the frame to urge the seat surface upward with respect to the frame from a lowered position when supporting the seated individual during use to an elevated position with respect to the frame assisting the individual during ingress or egress to or from the wheelchair, the lift assembly comprising a first portion mounted to the frame, a second portion mounted to the seating surface; a mechanical lift linkage extending from the first portion to the second portion, and an actuator engaging at least the first or second portion of the lift assembly;

a brake having a lock state engaging with the first and second wheel to block rotation of the first and second wheel with respect to the frame and an unlock state disengaging with the first and second wheel to allow rotation of the first and second wheel with respect to the frame;

a brake linkage communicating between the lift assembly and the brake to move the brake from the unlock state to the lock state when the seat surface moves from the lowered position to the elevated position, and a releasable stop to override the brake, to allow the first and second wheels to rotate independent of a position of the seat surface.

2. The wheelchair of claim 1, wherein the brake in the lock state blocks rotation of the first and second wheel with respect to the frame only against movement of the wheelchair backwards.

3. The wheelchair of claim 2, wherein the brake also blocks forward movement of the wheelchair when in the locked state.

4. The wheelchair of claim 1, wherein engagement of the releasable stop is configured to maintain the seat surface in the lowered position with respect to the frame in the absence of the seated individual to allow the first and second wheels to rotate.

5. The wheelchair of claim 1, wherein the frame provides hinging members allowing the frame to fold to bring the first and second wheels together with the separation distance less than a width of the seat surface.

6. The wheelchair of claim 1, further comprising a manually activated secondary brake to block rotation of the first and second wheel with respect to the frame independent of the brake being in the lock state or unlock state.

7. The wheelchair of claim 1, wherein the brake comprises a first spring loaded cam configured to rotatably engage one of the first and second wheels to block backwards movement of the wheelchair when the brake is in the lock state.

8. The wheelchair of claim 7, wherein the brake linkage exerts a force on the first spring loaded cam to overcome a spring force and disengage the first spring loaded cam from one of the first and second wheels when the seat surface is in the lowered position.

9. The wheelchair of claim 8, wherein the brake linkage comprises a bowden cable having a first end affixed to the first spring loaded cam and a second end affixed to the mechanical lift linkage of the lift assembly, and wherein movement of the seat surface into the lowered position pivots the mechanical lift linkage of the lift assembly to generate a tension in the bowden cable to overcome the spring force and disengage the first spring loaded cam.

10. The wheelchair of claim 8, wherein the brake linkage comprises a rotatable rod extending transversely below the seating surface from a first end affixed to an axis of rotation of the first spring loaded cam, and wherein movement of the seat surface into the lowered position exerts a rotational force on the rotatable rod in a direction opposite that of the spring force to overcome the spring force and disengage the first spring loaded cam.

11. The wheelchair of claim 7, wherein the brake further comprises a second spring loaded cam configured to rotatably engage one of the first and second wheels to block forward movement of the wheelchair when the brake is in the lock state.

12. The wheelchair of claim 1, wherein the brake comprises a brake bar extending transversely below the seating surface from a first end adjacent the first wheel to a second end adjacent the second wheel, a lever arm affixed generally perpendicularly to the brake bar, the lever arm having a first end affixed to the seating surface by a first resilient member and an opposing second end affixed to the seating surface by a second resilient member, and wherein when the seat surface is in the elevated position relative to the frame the second resilient member exerts a rotational force on the brake bar to engage the first and second wheel with corresponding ends of the brake bar in the lock state.

13. A wheelchair including a wheelchair lift assembly configured to assist an individual sitting into and/or rising from a wheelchair, comprising:

a frame providing a seat surface configured for supporting a seated individual;

a first and second wheel attached to the frame at left and right transversely opposed sides of the seat surface supporting the frame and positioned for rotation by the seated individual;

the lift assembly positioned between the seat surface and the frame to urge the seat surface upward with respect to the frame from a lowered position when supporting the seated individual during use to an elevated position with respect to the frame assisting the individual during ingress or egress to or from the wheelchair, the lift assembly comprising a first portion mounted to the frame, a second portion of the lift assembly comprising a seat pan defining the seat surface and having a cushion retainer thereon, the seat pan extending from the first side of the frame to the second side of the frame; a mechanical lift linkage extending from the first portion to the second portion, and an actuator engaging at least the first or second portion of the lift assembly;

a brake having a lock state engaging with the first and second wheel to block rotation of the first and second wheel with respect to the frame and an unlock state disengaging with the first and second wheel to allow rotation of the first and second wheel with respect to the frame; and, a brake linkage communicating between the lift assembly and the brake to move the brake from the unlock state to the lock state when the seat surface moves from the lowered position to the elevated position.

14. The wheelchair of claim 13, wherein the seat pan comprises a first member and a second member adjustably engaging the first member; and wherein the depth of the seat pan is variable by selectively adjusting a distance of overlap between the first and second members.

15. The wheelchair of claim 13, wherein the actuator comprises a first gas spring having a first end affixed to the mechanical lift linkage and an opposing second end extending from the first portion of the lift assembly that is mounted to the frame.

16. The wheelchair of claim 15, wherein the first gas spring is positioned adjacent the first side of the frame; and, wherein the actuator comprises a second gas spring positioned adjacent the second side of the frame having a first end affixed to the mechanical lift linkage and an opposing second end extending from the first portion of the lift assembly that is mounted to the frame.

17. A wheelchair including a wheelchair lift assembly configured to assist an individual sitting into and/or rising from a wheelchair, comprising:

a frame providing a seat surface configured for supporting a seated individual;

a first and second wheel attached to the frame at left and right transversely opposed sides of the seat surface supporting the frame and positioned for rotation by the seated individual;

the lift assembly positioned between the seat surface and the frame to urge the seat surface upward with respect to the frame from a lowered position when supporting the seated individual during use to an elevated position with respect to the frame assisting the individual during ingress or egress to or from the wheelchair, wherein the lift assembly further comprises a first and second lift subassembly and each of the first and second lift subassemblies comprise a first portion of the lift subassembly mounted to the frame; a second portion of the lift subassembly mounted to the seating surface; a mechanical lift linkage extending from the first portion of the lift subassembly to the second portion of the lift subassembly and an actuator engaging at least the first or second portion of the lift subassembly;

a brake having a lock state engaging with the first and second wheel to block rotation of the first and second wheel with respect to the frame and an unlock state disengaging with the first and second wheel to allow rotation of the first and second wheel with respect to the frame; and, a brake linkage communicating between the lift assembly and the brake to move the brake from the unlock state to the lock state when the seat surface moves from the lowered position to the elevated position.

18. The wheelchair of claim 17, wherein the first portion of the first lift subassembly is mounted to a horizontal bar of a first side of the frame adjacent the first wheel and the first portion of the second lift subassembly is mounted to a horizontal bar of a second side of the frame adjacent the second wheel, and wherein the second portion of the first and second lift subassemblies are releasable from the seating surface.

19. A wheelchair seat lift kit configured to assist an individual sitting into and/or rising from a wheelchair, comprising:

a seat surface configured for supporting a seated individual;

a lift assembly configured to be positioned between the seat surface and a frame of the wheelchair to urge the seat surface upward from a lowered position when supporting the seated individual during use to an elevated position with respect to the frame assisting the individual during ingress or egress to or from the wheelchair, the lift assembly comprising a first portion configured to be mounted to the frame, a second portion mounted to the seating surface; a mechanical lift linkage extending from the first portion to the second portion, and an actuator engaging at least the first or second portion of the lift assembly;

a brake having a lock state engaging with a first and second wheel of the wheelchair to block rotation of the first and second wheel with respect to the frame and an unlock state disengaging with the first and second wheel to allow rotation of the first and second wheel with respect to the frame; and a brake linkage communicating between the lift assembly and the brake to move the brake from the unlock state to the lock state when the seat surface moves from the lowered position to the elevated position, and a releasable stop to override of the brake, to allow the first and second wheels to rotate independent of a position of the seat surface.

20. The wheelchair seat lift kit of claim 19, wherein the brake in the lock state blocks rotation of the first and second wheel with respect to the frame only against movement of the wheelchair backwards.

21. The wheelchair seat lift kit of claim 19, wherein engagement of the releasable stop is configured to maintain the seat surface in the lowered position with respect to the frame in the absence of the seated individual to allow the first and second wheels to rotate.

22. The wheelchair seat lift kit of claim 20, wherein the brake comprises a first spring loaded cam configured to rotatably engage one of the first and second wheels to block backwards movement of the wheelchair when the brake is in the lock state.

23. The wheelchair seat lift kit of claim 22, wherein the brake linkage exerts a force on the first spring loaded cam to overcome a spring force and disengage the first spring loaded cam from one of the first and second wheels when the seat surface is in the lowered position.

24. The wheelchair seat lift kit of claim 19, further comprising a manually activated secondary brake to block rotation of the first and second wheel with respect to the frame independent of the brake being in the lock state or unlock state.

25. The wheelchair seat lift kit of claim 19, wherein the second portion of the lift assembly comprises a seat pan defining the seat surface and having a cushion retainer thereon.

26. The wheelchair seat lift kit of claim 25, wherein the actuator comprises at least one gas spring having a first end affixed to the mechanical lift linkage and an opposing second end extending from the first portion of the lift assembly.

27. The wheelchair seat lift kit of claim 25, wherein the seat pan comprises a first member and a second member adjustably engaging the first member; and wherein the depth of the seat pan is variable by selectively adjusting a distance of overlap between the first and second members.

28. The wheelchair seat lift kit of claim 19, wherein the lift assembly comprises a first and second lift subassembly and each of the first and second lift subassemblies comprise a first portion of the lift subassembly configured to be mounted to the frame of the wheelchair; a second portion of the lift subassembly mounted to the seat surface; a mechanical lift linkage that extends from the first portion of the lift subassembly to the second portion of the lift subassembly and an actuator engaging at least the first portion or the second portion of the lift subassembly.

29. A wheelchair including a wheelchair lift assembly configured to assist an individual sitting into and/or rising from a wheelchair, comprising:

a frame providing a seat surface configured for supporting a seated individual;

a first and second wheel attached to the frame at left and right transversely opposed sides of the seat surface supporting the frame and positioned for rotation by the seated individual;

the lift assembly positioned between the seat surface and the frame to urge the seat surface upward with respect to the frame from a lowered position when supporting the seated individual during use to an elevated position with respect to the frame assisting the individual during ingress or egress to or from the wheelchair, the lift assembly comprising a first portion mounted to the frame, a second portion mounted to the seating surface; a mechanical lift linkage extending from the first portion to the second portion, and an actuator engaging at least the first or second portion of the lift assembly;

a brake having a lock state engaging with at least one the first and second wheels to block rotation of a corresponding at least one of the first and second wheels with respect to the frame and an unlock state disengaging with at least one of the first and second wheels to allow rotation of the corresponding at least one of the first and second wheels with respect to the frame; and, a releasable stop configured to maintain the seat surface in the lowered position with respect to the frame in the absence of the seated individual while maintaining first and second wheel rotation.

* * * * *